US007596331B2

(12) United States Patent
Kinokuni

(10) Patent No.: US 7,596,331 B2
(45) Date of Patent: Sep. 29, 2009

(54) IMAGE FORMING APPARATUS

(75) Inventor: Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 11/758,954

(22) Filed: Jun. 6, 2007

(65) Prior Publication Data

US 2007/0286643 A1 Dec. 13, 2007

(30) Foreign Application Priority Data

Jun. 9, 2006 (JP) ..... 2006-161002

(51) Int. Cl.
*G03G 15/02* (2006.01)

(52) U.S. Cl. ..... 399/50; 399/354; 399/55; 399/66; 399/127

(58) Field of Classification Search ..... 399/50, 399/55, 66, 127, 128, 149, 150, 343
See application file for complete search history.

(56) References Cited

U.S. PATENT DOCUMENTS 5,294,964 A * 3/1994 Oshiumi ..... 399/150
2001/0028803 A1* 10/2001 Yoda ..... 399/44
2001/0028817 A1* 10/2001 Tamura et al. ..... 399/297
2002/0051664 A1* 5/2002 Aoki et al. ..... 399/359
2004/0136749 A1* 7/2004 Kinoshita et al. ..... 399/129
2006/0056884 A1* 3/2006 Sawai et al. ..... 399/302

FOREIGN PATENT DOCUMENTS

JP 2001-194961 A 7/2001
JP 2004-184934 A 7/2004
JP 2004-252320 A 9/2004

* cited by examiner

*Primary Examiner*—Ali Alavi
*Assistant Examiner*—Evan Dzierzynski
(74) *Attorney, Agent, or Firm*—Fitzpatrick, Cella, Harper & Scinto

(57) ABSTRACT

An image forming apparatus includes an auxiliary charging member contacting an image bearing member and for being supplied with a bias of an identical polarity to a normal charge polarity of toner at a position downstream from a transfer portion where a transfer member is located and upstream from a charging portion where a charging member is located with respect to a rotation direction of the image bearing member. When rotation of the image bearing member is stopped and then resumed, application of a toner transfer bias to the transfer member is started before a contact position between the image bearing member and the auxiliary charging member during the rotation stop of the image bearing member first reaches the transfer portion.

12 Claims, 18 Drawing Sheets

IMAGE FORMING APPARATUS

FIELD OF THE INVENTION AND RELATED ART

The present invention relates to an image forming apparatus for collecting toner remaining on an image bearing member by a developing device after a toner image is formed on the image bearing member such as an electrophotographic photosensitive member or the like according to, e.g., an electrophotographic method.

In recent years, downsizing of an electrophotographic image forming apparatus has proceeded but there is a limit to realize overall downsizing of the image forming apparatus only by reducing sizes of respective means or equipment for an image forming process including steps of electric charging, light exposure, development, transfer, fixation, cleaning, etc.

Further, transfer residual toner (residual developer) on a photosensitive member (image bearing member) after the transfer is collected by a cleaning means (cleaner) to result in waste toner but it is preferable that the waste toner is not produced from the viewpoint of environmental protection.

For this reason, an image forming apparatus using a cleaner-less process in which the cleaner is removed and the transfer residual toner on the photosensitive member is collected from the photosensitive member by a developing means and then used again has been proposed (Japanese Laid-Open Patent Application (JP-A) 2001-194961).

The transfer residual toner is collected by the developing means by using a collecting method in which toner remaining in some amount on the photosensitive member is collected by a fog-removing bias (a fog-removing potential difference Vback between a DC voltage applied to the developing means and a surface potential of the photosensitive member) during a subsequent developing step or later.

According to this collecting method, the transfer residual toner is collected by the developing means and used again in a subsequent step or later, so that the waste toner can be prevented from being produced and an inconvenience of requiring maintenance can be reduced. Further, it is not necessary to provide a cleaning apparatus, so that there is a big advantage in space saving and it is possible to considerably reduce the image forming apparatus in size.

In order to efficiently collect the transfer residual toner by the developing means, an electroconductive brush or a fur brush is used as an auxiliary charging means (member) and disposed downstream from a transfer means and upstream from a charging means. By applying a bias of an identical polarity (negative) to a normal charge polarity (negative) to the auxiliary charging member, an electric charge is imparted to the transfer residual toner when the transfer residual toner passes through the auxiliary charging member to improve a collecting performance of the developing means (JP-A 2004-184934).

However, it is difficult to impart electric charges to all the transfer residual toner at one time by the auxiliary charging member while the transfer residual toner passes through the auxiliary charging member. In other words, a part of the transfer residual toner is blocked by the auxiliary charging member and temporarily accumulated by the auxiliary charging member. To the thus accumulated toner, the electric charges are imparted stepwise, so that the transfer residual toner is discharged from the auxiliary charging member.

The accumulated toner is reversely charged toner having an opposite polarity to a normal charge polarity of toner and produced during passage thereof through the developing means or the transfer means.

When an amount of the toner accumulated on the auxiliary charging member is increased, a charge imparting performance with respect to the toner is decreased, thus deteriorating the collecting performance of the developing means. As a result of repetition of this phenomenon, an amount of toner carried and held on the photosensitive member is increased, thus leading to an occurrence of fog.

For this reason, there has been proposed a method in which the accumulated toner is electrically discharged by, e.g., applying a bias to the auxiliary charging member (means) in a period for pre-multirotation or post-rotation during image formation or in a sheet interval during successive image formation.

JP-A 2004-252320 describes a constitution for discharging both of negative toner (first step) and positive toner (second step) by a discharging sequence during post-rotation and a constitution in which a rotation direction of a drum during the post-rotation is changed to a direction opposite from that during image formation.

JP-A 2004-184934 describes that a charging brush is vibrated by reversely rotating a photosensitive drum or stopping rotation of the photosensitive drum to mechanically discharge toner in a large amount from a charging brush roller as a charging means caused to contact the photosensitive drum.

The toner accumulated on the auxiliary charging member (means) is mechanically discharged to the photosensitive drum by the rotation stop and operation of the photosensitive drum (member). For this reason, when the stopped photosensitive drum is rotated again for starting image formation, the toner accumulated at a contact portion between the auxiliary charging member and the photosensitive drum is discharged. The thus discharged toner is reversely charged toner, so that it is necessary to avoid collection thereof by the developing device since the reversely charged toner adversely affects a subsequent image when it is collected by the developing device. For this reason, there arises such a problem that the discharged toner is deposited again on the auxiliary charging member when a voltage is applied to the auxiliary charging member, thus being continuously accumulated on the auxiliary charging member.

SUMMARY OF THE INVENTION

A principal object of the present invention is to solve the above-described problem. An object of the present invention is to prevent toner, mechanically discharged from an auxiliary charging brush (member) by rotation start of an image bearing member, from being deposited again on the auxiliary charging brush.

According to an aspect of the present invention, there is provided an image forming apparatus, comprising:

a rotatable image bearing member;

a charging member for electrically charging the image bearing member in contact with the image bearing member;

developing means for collecting toner from the image bearing member and developing an electrostatic latent image into a toner image on the image bearing member;

a transfer member for transferring the toner image onto a transfer material;

a first auxiliary charging member for electrically charging toner on the image bearing member after the transfer by applying a voltage of an identical polarity to a normal charge polarity of the toner to the first auxiliary charging member, the first auxiliary charging member contacting said image bearing member at a position downstream from a transfer portion and upstream from the charging member with respect to a movement direction of the image bearing member; and voltage control means for applying, when rotation of the image bearing member is started in response to input of an image forming signal, a voltage of the identical polarity to the transfer member for a period from a time when a contact area between the first auxiliary charging member and the image bearing member before the rotation of the image bearing member first reaches the transfer portion to a time when the contact area passes through and departs from the transfer portion.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(1) Image Forming Portion

Figure 1:
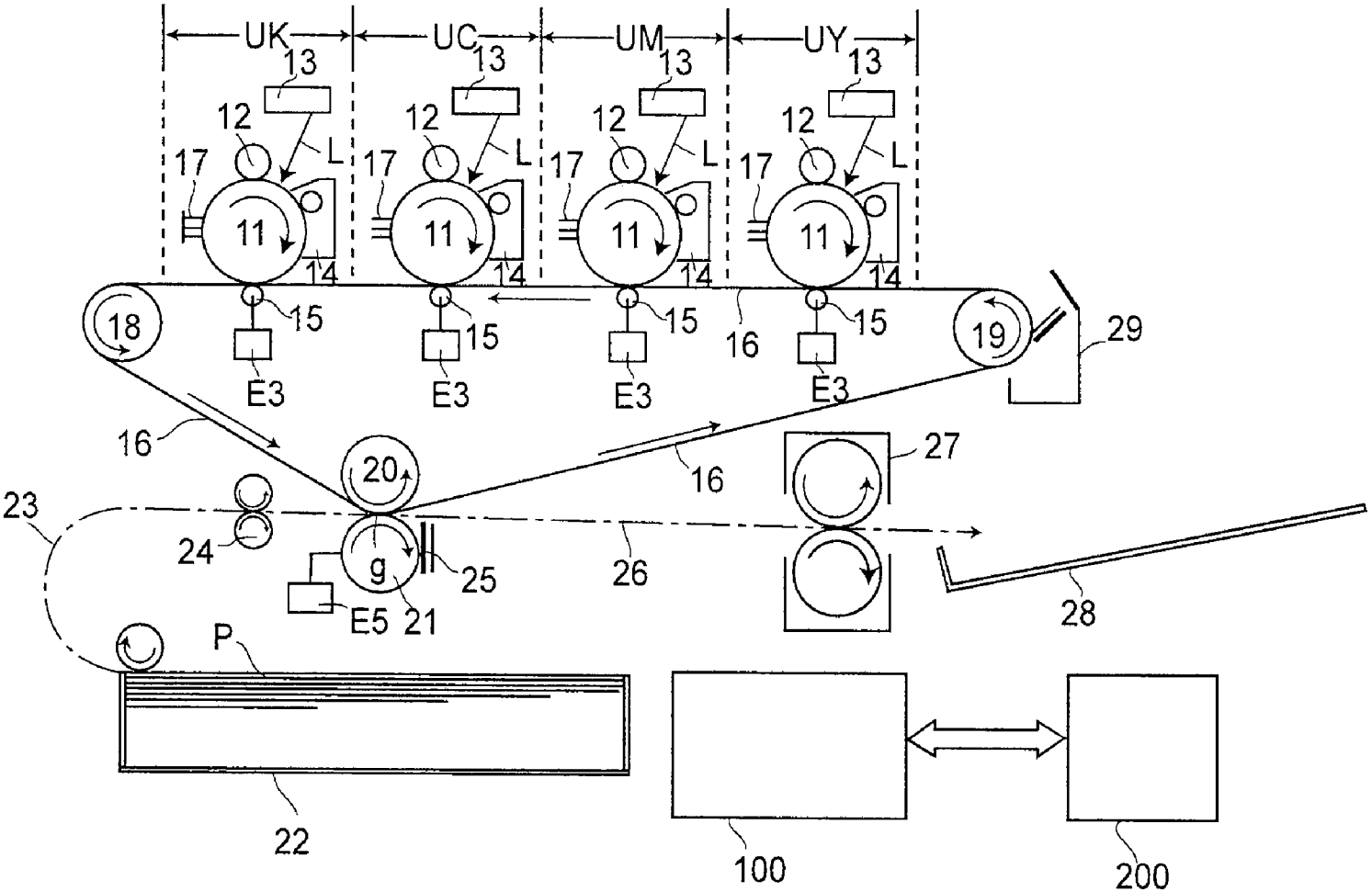
FIG. 1 is a schematic view showing an image forming apparatus in Embodiment 1.

FIG. 1 is a schematic view of an image forming apparatus according to the present invention. The image forming apparatus is an electrophotographic full-color printer. First, a general constitution of the image forming portion will be described.

Figure 2:
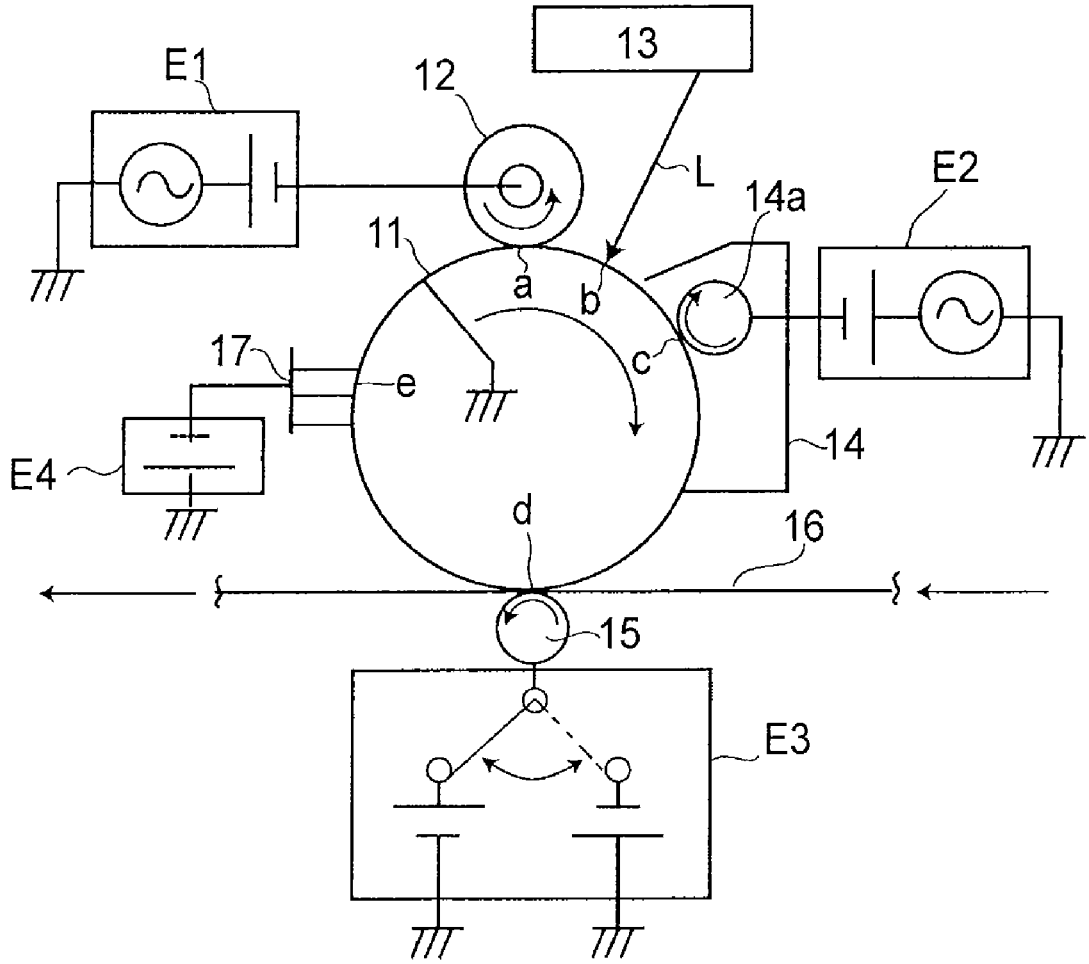
FIG. 2 is a schematic view showing an image forming unit.

Four (first to fourth) image forming units (image forming means) UY (yellow), UM (magenta), UC (cyan), and UK (black) are disposed along an intermediary transfer member. FIG. 2 is an enlarged view of one of the four image forming units.

Each image forming unit is an electrophotographic process mechanism for a cleaner-less system in which a developing means collect transfer residual toner. These image forming units differ only in color of a developer (toner) but have the same constitution in terms of an image forming mechanism.

More specifically, each image forming unit includes a drum-type electrophotographic photosensitive member 11 as an image bearing member (hereinafter referred to as a "drum"). The drum 11 is, e.g., prepared by applying a layer of a photoconductor such as an organic photoconductor (OPC), amorphous Si, CdS, or Se onto an outer peripheral surface of an aluminum cylinder. The drum 11 is rotationally driven in a clockwise direction indicated by an arrow at a predetermined speed by turning on a main motor (not shown) for the printer.

A charging roller 12 as a contact charging member has elasticity and electroconductivity and is pressed against the drum 11 at a predetermined pressing force. A contact portion therebetween is a charging portion a. The charging roller is rotated by rotation of the drum 11. As a material constituting the charging roller 12, it is possible to use ion-conductive or electron-conductive materials such as EPDM and NBR, and materials including rayon, a nylon-based material, and a fluorine-containing material. These materials have an electric resistance of $1.0\times10^5$-$1.0\times10^7$ Ω as an initial resistance in a normal temperature/normal humidity environment. The contact charging member (means) 12 may also be shaped in a fixed charging brush or a rotatable brush (charging brush roller).

To the charging roller 12, at a predetermined control timing, a predetermined charging bias including an AC voltage and a DC voltage is applied from a power source E1, whereby the surface of the rotating drum 11 is electrically charged uniformly to a predetermined polarity and a predetermined potential. In this embodiment, the surface of the drum 11 is negatively charged to have the predetermined potential. More specifically, by applying an oscillating voltage (charging bias voltage) in the form of a DC voltage of −500 biased with a sinusoidal wave AC voltage having a frequency of 1.3 kHz and a peak-to-peak voltage Vpp of 1.5 kV during image formation, the surface of the drum 1 is uniformly charged to −500 V (dark-part potential Vd) identical to the DC voltage.

An image-wise exposure means 13 as an image information writing means is a laser exposure apparatus and outputs a laser beam L modulated depending on image information to effect scanning exposure of the uniformly charged surface of the drum 11 to the laser beam L at an exposure portion b. As a result, an electrostatic latent image (image-wise latent image) is formed on the surface of the drum 11.

The latent image is visualized as a toner image at a developing portion c by a developing apparatus 14. More specifically, when the latent image formed on the drum surface passes through a position opposite to the developing apparatus 14 by the rotation of the drum 11, the latent image contacts a developing roller 14*a* rotated in a direction opposite from the rotation direction of the drum 11 to be visualized as the toner image on the drum 11. A contact portion or opposite portion between the drum 11 and the developing roller 14*a* is the developing portion c.

To the developing roller 14*a*, at a predetermined control timing, a predetermined developing bias including an AC voltage and a DC voltage is applied from a power source E2. In this embodiment, the electrostatic latent image is reversely developed with toner having a negative polarity as a normal charge polarity of toner (hereinafter referred to as "negative toner"). The toner in the developing apparatus has an amount of electric charge of 25-35 μC/mg. Further, in order to excessively increase a flowability of the toner, particles of oiltreated silica of 20 nm in particle diameter are contained in the developer in an amount of 30% or less. The developing bias is an oscillating voltage in the form of a DC voltage of −350 V biased with a rectangular wave AC voltage having a frequency of 8.0 kHz and a peak-to-peak voltage of 1.8 kV during image formation.

The developing apparatuses of the first to fourth image forming units UY, UM, UC and UK contain yellow toner, magenta toner, cyan toner, and black toner, respectively.

In the image forming apparatus, to a control circuit portion (control means) 100, a print start signal and a color separation image signal as full-color image information are sent from an external host apparatus 200 such as a personal computer, an image reader, or a facsimile apparatus. Based on these signals, the control circuit portion 100 controls the first image forming unit UY so that a yellow toner image is formed on the surface of the drum 11 at a predetermined control timing. Similarly, the control circuit portion 100 controls the second to fourth image forming units UM, UC and UK so that a magenta toner image, a cyan toner image, and a black toner image are formed, respectively, on a surface of an associated drum 11 at a predetermined control timing.

Each of the respective color toner images formed on the surfaces of the drums 11 for the respective image forming units is successively transferred in a superposition manner onto an endless and flexible intermediary transfer belt 16 as a transfer material (hereinafter referred to as a "belt"), to be rotationally driven, at a primary transfer portion d as a transfer member. As a result, on the surface of the belt 16, an unfixed full-color toner image is formed by superposition of the above-described four color toner images of yellow, cyan, magenta and black.

The belt 16 is extended around and stretched among a driving roller 18, a follower roller 19 as a tension roller, and a secondary transfer opposite roller 20 as a secondary transfer member and is rotationally driven in a counterclockwise direction indicated by an arrow at a speed substantially identical to the rotation speed of the drum 11. The belt 16 is, e.g., formed of polyimide (PI) resin and has a thickness of 5 μm, a surface resistance of $10^{11}$-$10^{13}$ Ω/□, and a volume resistivity of $10^{9}$-$10^{10}$ Ω·cm. As the material for the belt 16, it is also possible to use PVDF, PET, PBT, EPDM, NBR, urethane rubber, silicone rubber, etc.

The primary transfer portion d is created by causing a belt portion of the belt 16 between the driving roller 18 and the follower roller 19 to contact a lower surface of an associated drum 11 of the respective image forming units by a pressing force of an associated primary transfer roller 15. To the primary transfer roller 15, a predetermined transfer bias of an opposite polarity to the charge polarity of the negative toner is applied from a power source E3 during the primary transfer of the toner image. In this embodiment, a transfer bias having a position polarity and a predetermined potential is applied. During the image formation, to the primary transfer roller 15, a voltage of +2 kV is applied.

In each of the image forming units, toner remaining on the drum 11 that is not transferred onto the belt 16 reaches a contact portion e between a fixed auxiliary charging brush (hereinafter referred to as a "brush") as an auxiliary charging member and the drum 11 by further rotation of the drum 11. The toner is carried and held by the drum 11 from the contact portion e to the developing portion c through the charging portion a and the exposure portion b, thus being collected by the developing apparatus 14.

The unfixed full-color toner image formed on the surface of the belt 16 reaches a secondary transfer portion g by further rotation of the belt 16. The secondary transfer portion g is created by nipping the belt 16 between the secondary transfer opposite roller 20 and a secondary transfer roller 21. Accordingly, a nip portion between the belt 16 and the secondary transfer roller 21 is the secondary transfer portion g.

To the secondary transfer portion g, a sheet-like recording material P is fed from a sheet (paper)-feeding apparatus 22, so that the unfixed full-color toner image on the surface of the belt 16 is collectively secondary-transferred successively onto the surface of the recording material P. During the secondary transfer of the toner image, from a power source E5, a predetermined secondary transfer bias of an opposite polarity to the charge polarity of the negative toner is applied to the secondary transfer roller 21. In this embodiment, a secondary transfer bias having a positive polarity and a predetermined potential is applied.

In the sheet-feeding apparatus 22, sheets of the recording material P are stacked and accommodated. A sheet-feeding operation for one sheet of the recording material P is performed at a predetermined control timing. The fed recording material P is conveyed to a registration roller pair 24 through a sheet path 23. At this time, rotation of the registration roller pair is stopped, so that a leading end of the recording material P reaches the nip portion. As a result, the conveyance of the recording material P to the secondary transfer portion g is synchronized with the operation of the image forming portion and at the same time, oblique movement of the recording material P is corrected. Thereafter, in synchronism with a timing of start of image formation by each of the image forming units UY, UM, UC and UK, the rotational drive of the registration roller pair 24 is started. This timing of the rotation start of the registration roller pair 24 is set so that the leading end of the recording material P coincides with a front end of the toner image transferred from each image forming unit, at the secondary transfer portion g.

The recording material P onto which the toner image is secondary-transferred from the surface of the belt 16 at the secondary transfer portion g is separated from the belt 16 surface by a separating apparatus 25 and introduced into a fixing apparatus 27 through a sheet path 26. The unfixed toner image on the recording material P is fixed on the surface of the recording material P under application of heat and pressure by the fixing apparatus. The recording material P coming out of the fixing apparatus 27 is discharged and mounted on a sheet discharge tray 28.

The transfer residual toner remaining on the belt 16 that is not being transferred onto the recording material P at the secondary transfer portion g is removed by a belt cleaning apparatus 29 for cleaning an image forming surface of the belt 16.

In the case of a white/black image mode, apparatus control is performed so that only the fourth image forming unit UK for forming the black toner image is actuated for image formation.

Figure 3:
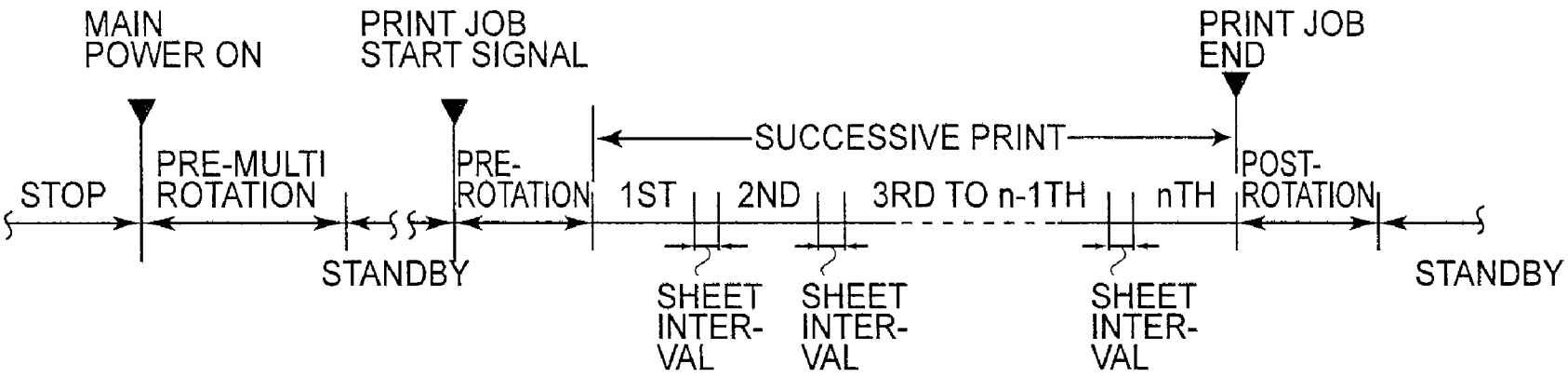
FIG. 3 is a schematic view for illustrating an operation procedure of an image forming apparatus.

FIG. 3 shows an operation step diagram of the above-described image forming apparatus.

1) Pre-Multirotation Step

This step is performed in a predetermined start (actuation) operation period (warm-up period) of the image forming apparatus. In this step, a main power switch of the image forming apparatus is turned on to actuate a main motor of the image forming apparatus a preparation operation of necessary process equipment is performed.

2) Standby State

After the predetermined start operation period is ended, the drive of the main motor is stopped and the image forming apparatus is kept in a standby state until a print job start signal is inputted.

3) Pre-Rotation Step

In a period for a pre-rotation step, the main motor is driven again on the basis of the input of the print job start signal to perform a print job pre-operation of necessary process equipment.

In an actual operation, (a) the image forming apparatus receives the print job start signal, (b) an image is decompressed by a formatter (a decompression time varies depending on an amount of image data or a processing speed of the formatter, and then (c) the pre-rotation step is started.

Incidentally, in the case where the print job start signal is inputted during the pre-multirotation step 1), after the pre-multirotation step 1) is completed, the operation goes to this pre-rotation step 3) without a standby state 2).

4) Print Job Execution

Immediately after the predetermined pre-rotation step is completed, the above-described image forming process is executed, so that a recording material on which the image has been formed is outputted. In the case of a successive print job, the image forming process is repeated, a predetermined number of sheets of the image-formed recording material are outputted.

5) Sheet Interval Step

This step is a step of an interval between a trailing end of a recording material P and a leading end of a subsequent recording material P in the case of the successive print job. A period for this step corresponds to a non-sheet passing state period at the transfer portion or in the fixing apparatus.

6) Post-Rotation Step

In a predetermined period for a post-rotation step, the main motor is continuously driven for a predetermined time even after the image-formed recording material is outputted in the case of the print job for one sheet or after a final image-formed recording material is outputted in the case of the successive print job. In this period, a print job post-operation of necessary process equipment is performed.

7) Standby State

After the predetermined post-rotation step is completed, the drive of the main motor is stopped and the image forming apparatus is kept in a standby state until a subsequent print job start signal is inputted.

In the above-described operation, the period for the print job execution 4) is an image forming period, and the periods for the pre-multirotation step 1), the pre-rotation step 3), the sheet interval step 5), and the post-rotation step 6) are a non-image forming period.

Herein, the non-image forming period means at least one of the periods for the above-described steps 1), 3), 5) and 6) or at least a predetermined (period of) time in the periods for these steps.

(2) Cleaner-Less System

In each of the image forming units, the toner remaining on the drum 11 surface that is not being transferred onto the belt 16 during the primary transfer of the toner image from the drum 11 onto the belt 16 passes through the contact portion e between the drum 11 (photosensitive member) and the brush 17 (auxiliary charging member).

To the brush 17, from a power source E4, a bias of an identical polarity to the charge polarity of the negative toner as normal toner is applied. In this embodiment, a negative DC voltage is applied.

The brush 17 is constituted by fibers. For example, in the case of the fixed brush, electroconductive rayon fibers having a fineness of 6 denier, a pile length of 5 mm, and a fiber (filament) density of 100 kilo-filaments/square inch In addition to the rayon fibers, it is possible to use nylon fibers or polyester fibers which may preferably have a fineness of 2-10 denier, a pile length of 3-8 mm, and a fiber density of 50-500 kilo-filaments/square inch. The shape of the auxiliary charging member 17 may also be a rotation brush (brush roller) or a charging roller.

In many cases, toner remaining on the drum 11 that is not being transferred onto the belt 16 in each image forming unit contains a small amount of negative toner component as the normal toner. That is, the positively charged toner, i.e., the reversely charged toner(hereinafter referred to as "positive toner") is a dominant component.

By applying a bias of an identical polarity to the charge polarity of the negative toner to the brush 17, negative electric charges identical in polarity to the negative toner are imparted to the positive toner by electric discharge (electric charging) when the positive toner passes through the contact portion e between the drum 11 and the brush 17.

By imparting this negative charge, the transfer residual toner containing the dominant positive toner component is caused to have an identical polarity to the charge polarity of the negative toner as the normal toner by being passed through the contact portion e between the drum 11 and the brush 17 and is carried and held on the drum 11 to the developing portion c through the charging portion a and the exposure portion b by further rotation of the drum 11. The transfer residual toner is collected by the developing apparatus 14 according to simultaneous developing and cleaning.

As described above, the transfer residual toner remaining on the drum 11 normally charged by the auxiliary charging member and is then collected by the developing apparatus 14 through simultaneous developing and cleaning. As a result, the cleaner-less system for cleaning the surface of the drum 11 that is not using a cleaner is realized.

(3) Discharging Process of Toner from Brush 17

In the case where the negative electric charge impartation to the transfer residual toner is not sufficiently performed by the electric discharge (electric charging) at the contact portion e between the drum 11 and the brush 17, the positive toner component of the transfer residual toner is deposited on the brush 17. This may occur under various conditions including the case of a large transfer bias, the case of a large amount of the transfer residual toner, the case of a large amount of the reversely charged toner component generated in the developing apparatus in a low temperature/low humidity environment, and the like case. Particularly, under these conditions, when the image formation is continuously performed, the positive toner is gradually deposited on the brush 17. With an increase in amount of the deposited positive toner, an electric charge imparting ability of the brush 17 with respect to the transfer residual toner is also gradually lowered. When the lowering in electric charge imparting ability of the brush 17 reaches a limit value, the positive toner component in the transfer residual toner passing through the brush 17 is deposited and accumulated on the charging roller 12 to cause an occurrence of fog and image failure due to charging non-uniformity.

In this embodiment, the foregoing problem is solved by efficiently performing toner discharge from the brush 17 to the drum 11 (image bearing member).

More specifically, when the rotation of the drum 11 is stopped and then resumed, application of a predetermined bias to the primary transfer roller 15 is started before a contact area of the drum 11 with the brush 17 during the stop of the rotation of the drum 11 first reaches the primary transfer portion d. In a state in which the bias of the identical polarity to the normal charge polarity of the toner is applied, at least the contact area is caused to pass through the primary transfer portion e, whereby the reversely charged toner in the contact area is transferred from the drum 11. By such a constitution, it is possible to prevent the reversely charged toner from accumulating on the auxiliary charging member.

Hereinafter, a method of effecting the toner discharge process will be described.

The toner discharge process is effected during non-image formation of the image forming apparatus. More specifically, the toner discharge process is executed during at least one of predetermined periods selected from a period for pre-multi-rotation after turning-on of a main power switch and before the process goes to a standby state, a period for returning the process to an ordinary state after recovery from recording material jam or communication failure, a period for pre-rotation before image formation on a first sheet of the recording material, and the like period.

(During Pre-Multirotation after Turning-On of Main Power Switch and before a Standby State)

During the pre-multirotation, a sequence for performing the toner discharge process is set.

(Pre-Rotation)

The toner discharge is executed depending on the number of sheets subjected to image formation during rotation of the image bearing member performed after an image forming signal is inputted so as to start the rotation and before the toner image is actually formed on the image bearing member.

(During Jam or Communication Failure)

Since a ratio of the transfer residual toner is increased, the toner discharge process is performed every time during rotation after recovery from a jam or a communication failure.

A procedure of the toner discharge process in this embodiment is as follows.

Figure 4:
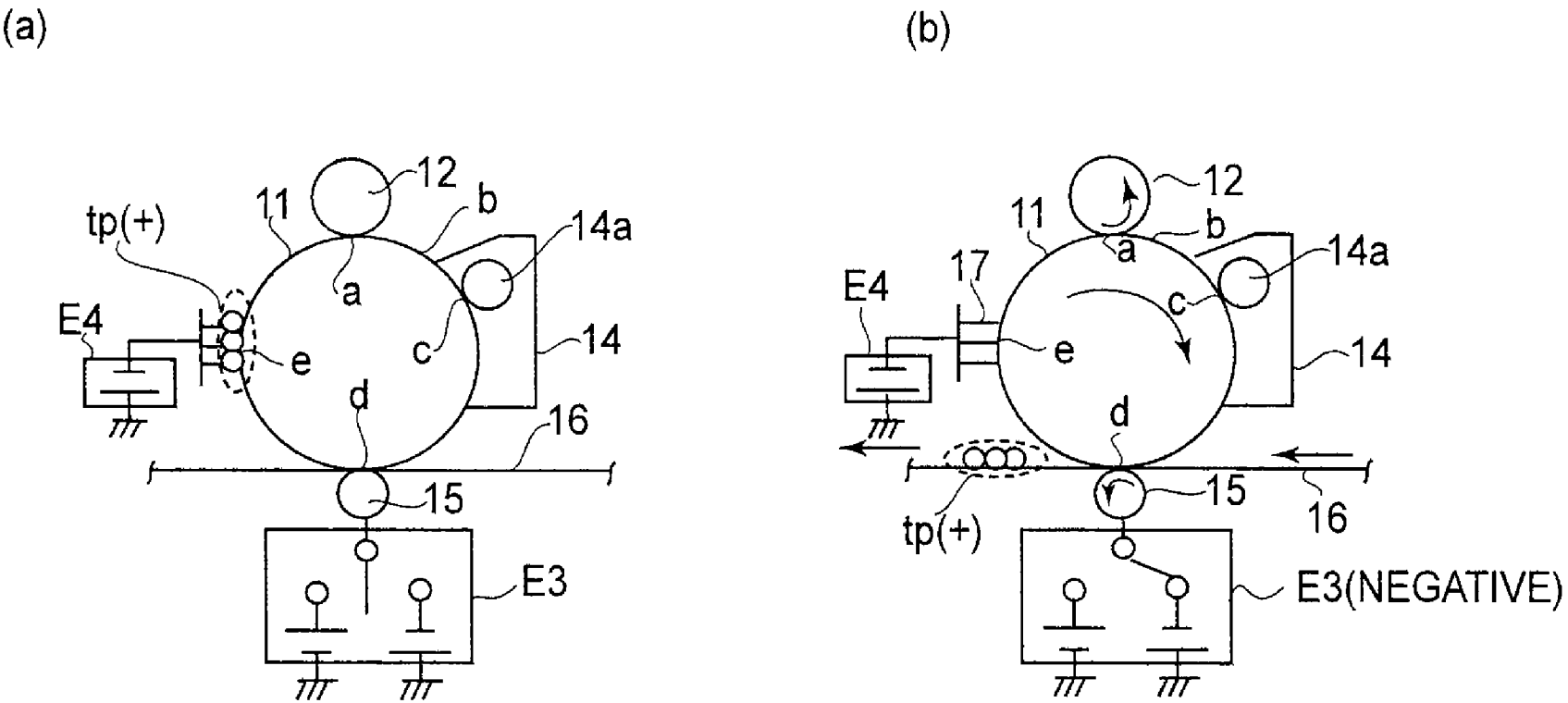
FIGS. 4(*a*) and 4(*b*) are schematic views for illustrating a toner discharging process of an image forming unit.

A positive toner tp deposited and accumulated on the brush 17 is deposited on the drum 11 by mechanical vibration during drum rotation stop (FIG. 4(*a*)). The thus discharged toner tp is transferred onto the belt 16 at the primary transfer portion d by applying a bias to the primary transfer roller 15 during rotation of the drum 11 by input of a subsequent image forming signal (FIG. 4(*b*)). The thus transferred toner on the belt 16 is collected by a belt cleaning apparatus 29.

The charge polarity of toner deposited or accumulated on the brush 17 is dominantly positive as described above. For this reason, the primary transfer bias applied to the primary transfer roller 15 is a predetermined potential bias of a negative polarity identical to the charge polarity of the negative toner as the normal toner.

In this embodiment, toner discharged from the brush 17 onto the drum 11 by mechanical vibration means toner discharged by vibration during step of rotation of the drum 11 after the image formation is completed. With respect to an amount of toner discharged from the brush 17 onto the drum 11, it has been confirmed by an experiment that an amount of toner discharged by mechanical vibration is 2 to 3 times larger than that discharged electrically.

Figure 5:
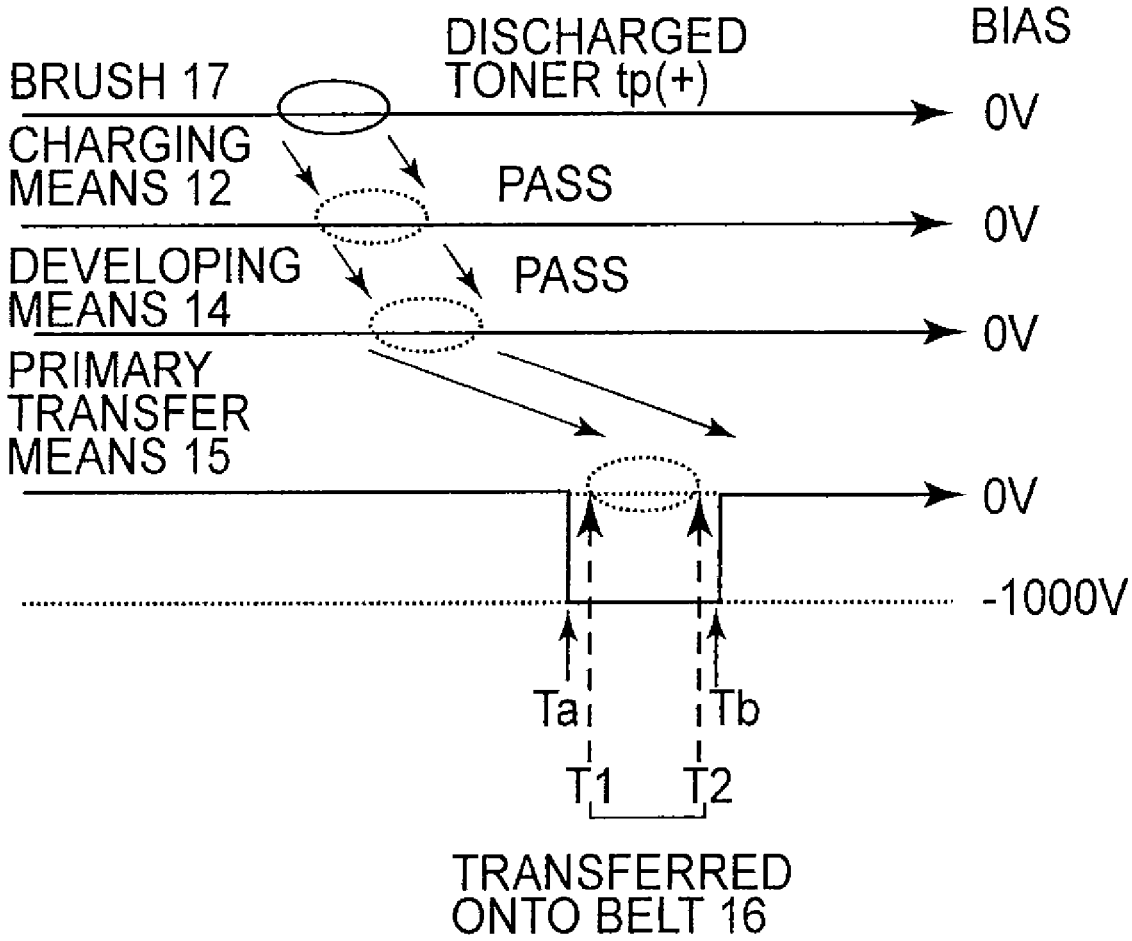
FIGS. 5 and 6 are time charts of a toner discharging process.

The control circuit portion 100 as a voltage control portion controls the bias applied to the primary transfer roller 15 as described above before the toner tp discharged onto the drum 11 at the contact portion e between the drum 11 and the brush 17 by mechanical vibration during previous stop of the drum rotation reaches the transfer portion by subsequent (current) drum rotation. More specifically, as shown in a time chart during the toner discharge in FIG. 5, the bias applied to the primary transfer roller 15 is controlled to have a negative polarity identical to the charge polarity of the negative toner as the normal toner. In FIG. 5, T1 represents a time at which a drum position at the contact portion e of the drum with the brush 17 (a front end of an contact area) during a drum rotation stop state, i.e., a position of a drum portion on which the toner tp discharged from the brush 17 is deposited reaches the primary transfer portion d after the drum 11 in the rotation stop state is rotationally actuated. Further, T2 represents a time at which the position of the drum portion has passed through the primary transfer portion d (a rear end of the contact area). The reaching time T1 and the passing time T2 can be estimated in advance from a peripheral length of the drum from the contact portion e to the primary transfer portion d with respect to the drum rotation direction, a width of the brush 17 with respect to the drum rotation direction, and a width of the primary transfer portion d with respect to the drum rotation direction. Ta represents a first control time earlier than the reaching time T1 by a predetermined time, and Tb represents a second control time later than the passing time T2 by a predetermined time. The bias voltage is required to be applied to the transfer roller under the above-described condition at least during the passing of the contact area between the drum 11 and the brush 17.

The first and second control times Ta and Tb are set as time limits in a timer function portion of the control circuit portion 100. The control circuit portion 100 starts a time period of the timer function portion simultaneously with the rotational actuation of the drum 11 in a rotation stop state.

The control circuit portion 100 controls the bias applied from the power source E3 to the primary transfer roller 15 so as to be changed from 0 V to −1000 V at a time when the timer function portion counts the time limit Ta. As a result, application of a transfer bias of −1000 V to the primary transfer roller 15 is started before the position of the toner deposited drum portion reaches the primary transfer portion d by rotationally actuating the drum 11.

Further, the control circuit portion 100 effects control so that the bias applied from the power source E3 to the primary transfer roller 15 is changed from −1000 V to 0 V at a time when the timer function portion counts the time limit Tb. As a result, the bias applied to the primary transfer roller 15 is returned from −1000 V to 0 V after the toner deposited drum portion position passes through the primary transfer portion d.

The power source E3 for bias application to the primary transfer roller 15 includes a power source for applying a negative bias to the primary transfer roller 15 and a power source for applying a positive bias to the primary transfer roller 15 as shown in FIGS. 2, 4(*a*) and 4(*b*). The control circuit portion 100 is capable of controlling the bias application state in a negative bias application state, a positive bias application state, and no bias application state (0 V state) with respect to the primary transfer roller 15 by selectively switching these two power sources.

As described above, by controlling the bias applied to the primary transfer roller 15, it is possible to remove the toner from the surface of the drum 11 by efficiently transferring the toner, dominantly containing the positive toner tp and discharged onto the drum 11, onto the belt 16. The thus transferred toner onto the brush 16 can be collected by the brush cleaning apparatus 29. In this embodiment, the positive toner is principally transferred onto the belt 16 and the negative toner remains on the drum 11. The remaining negative toner does not adversely affect a subsequent image even when it is collected by the developing means, so that the positive toner may be transferred onto the belt 16.

Figure 6:
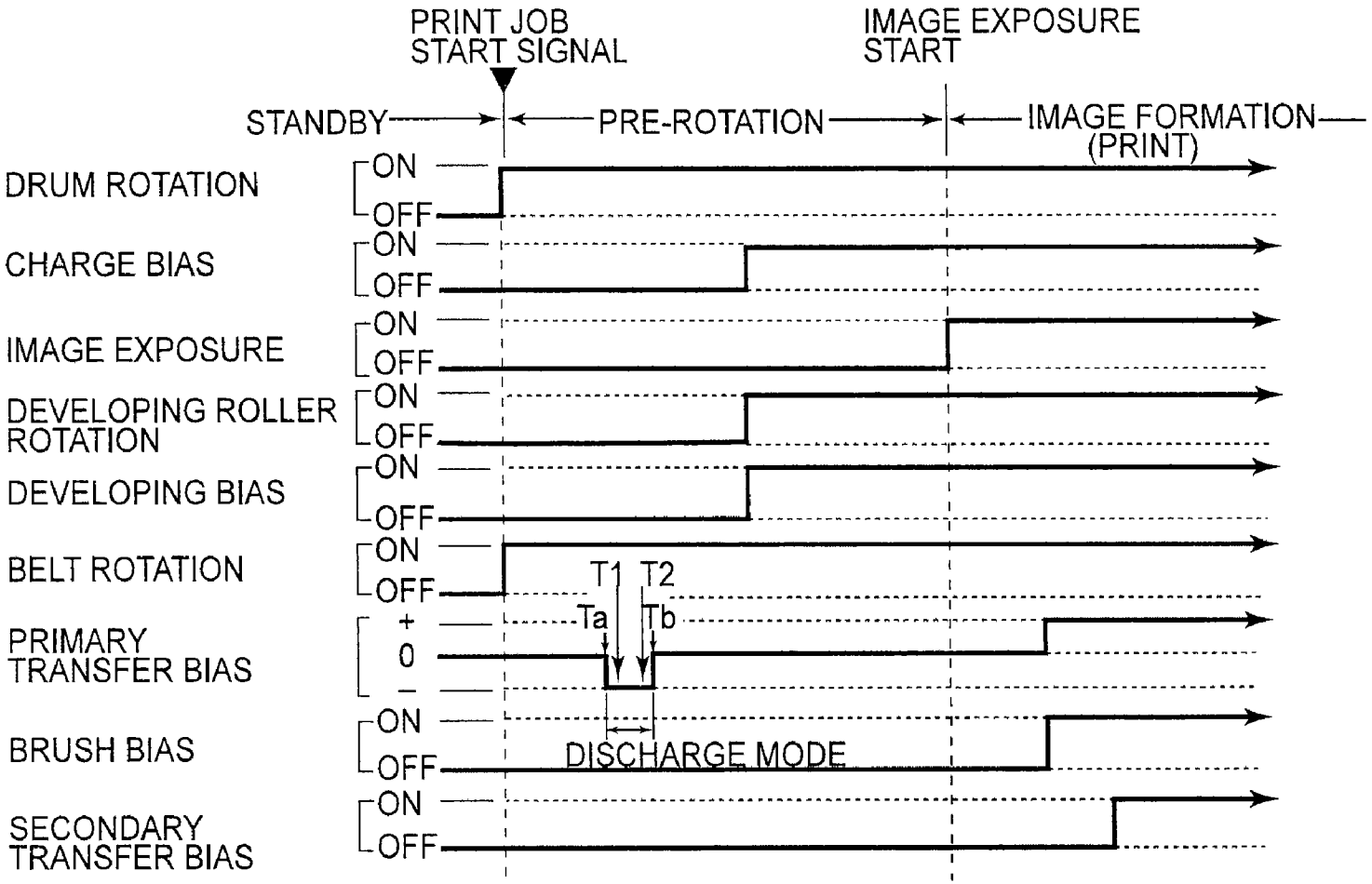

FIG. 6 is a time chart of control for performing the above-described toner discharge process during the pre-rotation of the image forming apparatus. During the toner discharge process mode, application of the charging bias to the charging roller 12 is turned off (0 V). In this case, application of the DC voltage is at least turned off. More specifically, the bias of the identical polarity to the charge polarity of the negative toner as the normal toner is not applied to the charging roller 12, so that toner deposited and contamination of the charging roller 12 caused by passing the positive toner tp deposited from the brush 17 onto the drum 11 through the charging portion a.

Further, until the deposited toner tp on the drum 11 passes through the developing portion c, the developing apparatus 14 is not driven, i.e., the developing roller 14*a* is not rotationally driven in order not to collect the deposited toner tp by the developing apparatus 14. To the developing roller 15*a*, the developing bias is not applied. At least, it is necessary to turn off the application of the DC voltage. This is because it is difficult to retain a performance of the developing apparatus 14 by using, as reuse toner, the positive toner tp deposited on the brush 17, different from the transfer residual toner which dominantly contains the negative toner and passes through the brush 17 during an ordinary image forming operation.

Further, application of the secondary transfer bias to the secondary transfer roller 21 is turned off. As a result, the secondary transfer roller 21 is prevented from being contaminated by toner deposited with the transferred toner on the belt 16 passing through the secondary transfer portion g. It is also possible to prevent toner deposition contamination of the secondary transfer roller 21 by employing such a mechanism that the secondary transfer roller 21 is moved apart from the belt 16 during the passing of the transferred toner on the belt 16 through the secondary transfer portion g. Further, by applying the bias of the opposite polarity to the charge polarity of the normal toner, it is also possible to prevent the transferred toner on the belt 16, containing the dominant positive toner component, from depositing on the secondary transfer roller 21.

As a result, by efficiently collecting toner deposited on the brush 17 as the auxiliary charging means, it is possible to solve the problem of the occurrence of fog and image failure throughout continuous image formation.

The discharge of the toner from the brush 17 to the drum 11 by mechanical vibration can also be effected by, in addition to mechanical vibration during the drum rotation stop, providing a brush vibrating means for actively vibrating or shaking the brush 17 at the time of or during the stop of the rotation of the drum 11. For example, the brush vibrating means may be a vibrator mechanism, a reciprocation shaking mechanism, a tapping mechanism, etc. The control circuit portion 100 actuates the brush vibrating means at the time of or during the rotation stop of the drum 11, so that toner is discharged from the brush 17 onto the drum 11 by actively mechanical vibration.

Embodiment 2

Figure 7:
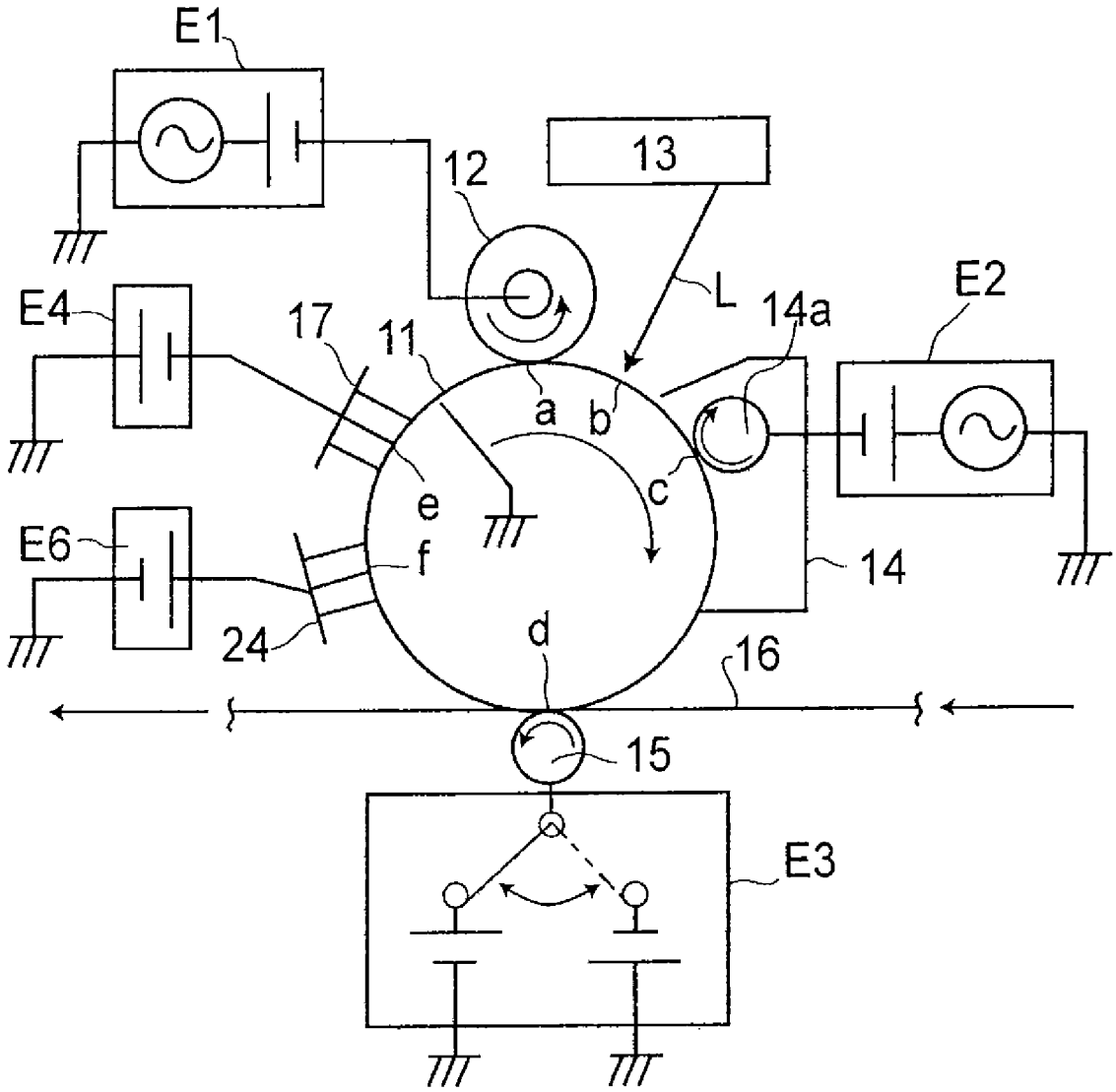
FIG. 7 is a schematic view showing an image forming unit of an image forming apparatus in Embodiment 2.

An image forming apparatus of this embodiment is prepared by providing another auxiliary charging means 24 to each image forming unit of the image forming apparatus of Embodiment 1, in addition to the auxiliary charging means 17 as described above, as shown in FIG. 7. Other mechanical constitutions are identical to those for the image forming apparatus of Embodiment 1, so that a redundant description will be omitted.

The auxiliary charging means 24 (second auxiliary charging member) is disposed deposit from the primary transfer portion d and upstream from the auxiliary charging means 17 with respect to the drum rotation direction. The auxiliary charging member (means) 24 is referred to as an upstream auxiliary charging member and the auxiliary charging member (means) 17 is referred to as a downstream auxiliary charging member.

The downstream auxiliary charging member 17 is a fixed auxiliary charging brush contacting the drum 11 similarly as in Embodiment 1 (hereinafter referred to as a "downstream brush") and to the downstream brush 17, a predetermined bias of a negative polarity identical to the charge polarity of the negative toner as the normal toner is applied from the power source E4.

The upstream auxiliary charging member 24 is also a fixed auxiliary charging brush contacting the drum 11 (hereinafter referred to as an "upstream brush") and to the upstream brush 24, a predetermined bias of a positive polarity opposite to the charge polarity of the negative toner as the normal toner is applied from a power source E6. Fibers constituting the upstream brush 24 and a shape thereof are similar to those for the downstream brush 17. A contact portion f is created between the upstream brush 24 and the drum 11.

The upstream brush 24 supplied with the bias of the opposite polarity to the charge polarity of the normal toner has the function of obviating potential non-uniformity on the drum 11 after the drum 11 passes through the primary transfer portion to prevent an occurrence of a ghost image due to image memory or the like. The applied bias may be biased with an AC voltage as desired, thus being improved in effect thereof.

Figure 8:
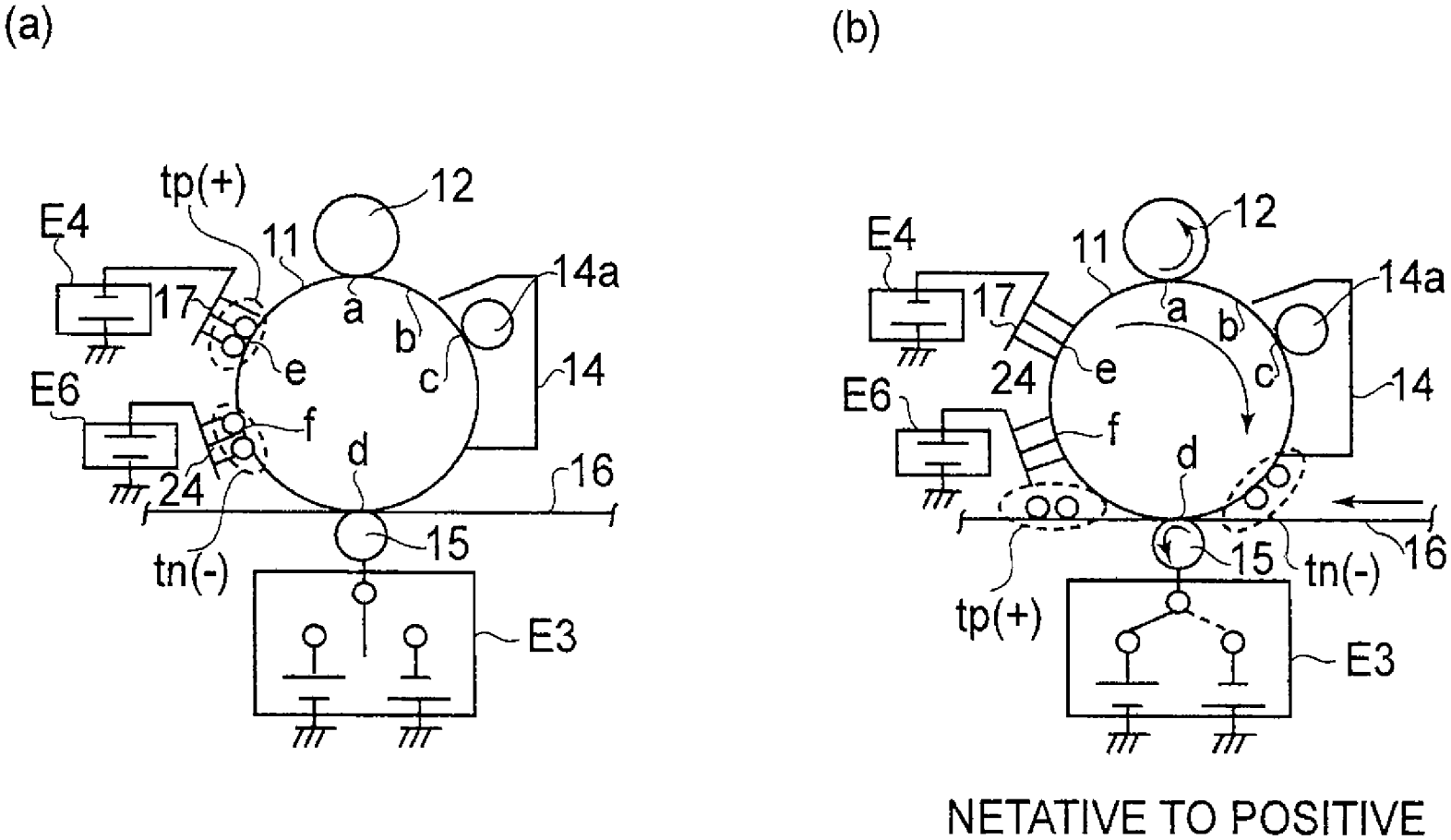
FIGS. 8(*a*) and 8(*b*) are schematic views for illustrating a toner discharging process of an image forming unit.

In this embodiment, during continuous image formation, the toner is deposited on both of the upstream brush 24 and the downstream brush 17. The toner of the identical polarity to the charge polarity of the normal toner (hereinafter referred to as "negative toner" is dominant in toner deposited and accumulated on the upstream brush 24, and the positive toner of the opposite polarity to the charge polarity of the normal toner is dominant in the toner deposited and accumulated on the downstream brush 17. By mechanical vibration during the drum rotation stop, toner is discharged from each of the upstream brush 24 and the downstream brush 17 onto the drum 11. FIG. 8(*a*) shows a state in which by mechanical vibration during the drum rotation stop, the negative toner tn is discharged from the upstream brush 24 onto the drum 11 and the positive toner tp is discharged from the downstream brush 17 onto the drum 11.

Figure 9:
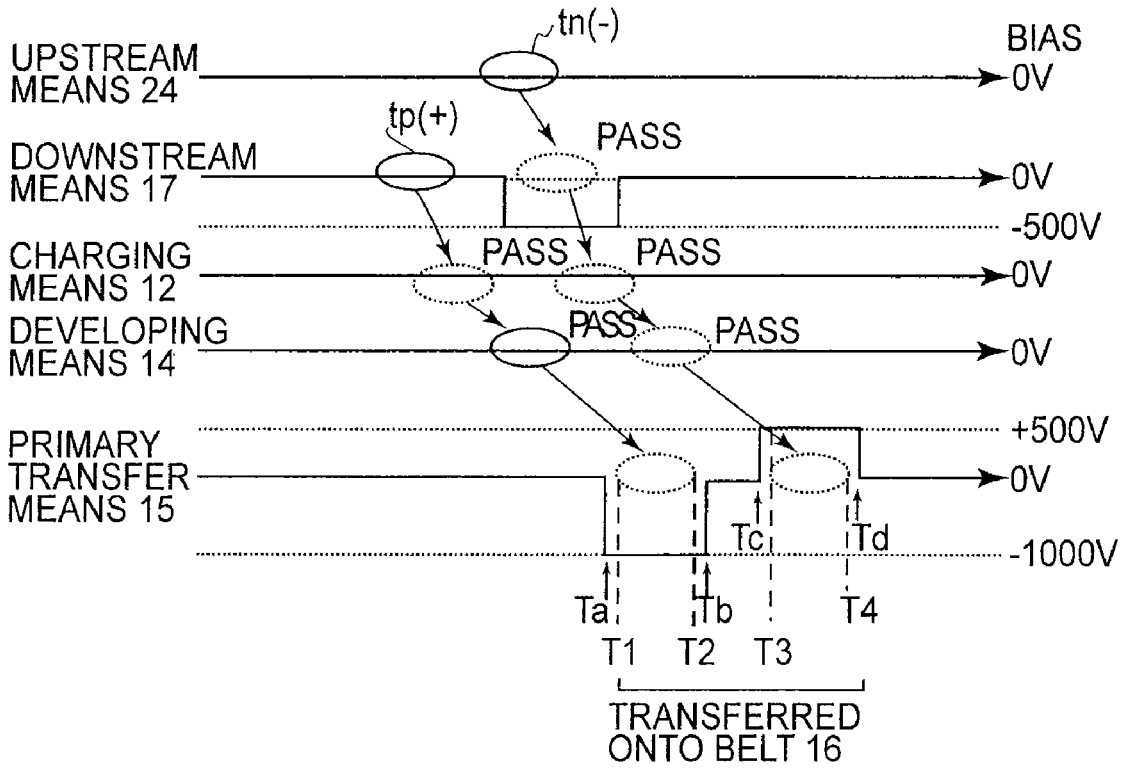
FIGS. 9 and 10 are time charts of a toner discharging process.

The control circuit portion 100 controls a bias applied to the primary transfer roller 15 as shown in FIG. 9 before the positive toner tp discharged onto the drum 11 at the contact portion e between the drum 11 and the downstream brush 17 reaches the primary transfer portion d by subsequent drum rotation. Further, the control circuit portion 100 controls the bias applied to the primary transfer roller 15 as shown in FIGS. 8(*b*) and 9 before the negative toner tn deposited onto the drum 11 at the contact portion f between the drum 11 and the upstream brush 24 reaches the primary transfer portion d subsequently to the positive toner tp.

A sequence of a process mode for the positive toner tp discharged from the downstream brush 17 is the same as in Embodiment 1. As a result, the positive toner tp discharged from the downstream brush 17 onto the drum 11 is efficiently transferred onto the belt 16 at the primary transfer portion d, thus being removed from the surface of the drum 11.

To the negative toner tn discharged from the upstream brush 24, the negative polarity bias of the identical polarity to the charge polarity of the negative toner is applied when the negative toner passes through the contact portion e between the downstream brush 17 and the drum 11, thereby to prevent toner deposition contamination of the downstream brush 17.

Further, to the primary transfer roller 15, after the positive toner passes through the primary transfer portion d and before the negative toner tn reaches the primary transfer portion d, the bias of the opposite polarity to the charge polarity of the negative toner is applied. As a result, the negative toner tn discharged from the upstream brush 24 onto the drum 11 is efficiently transferred onto the belt 16, thus being removed from the surface of the drum 11.

Figure 10:
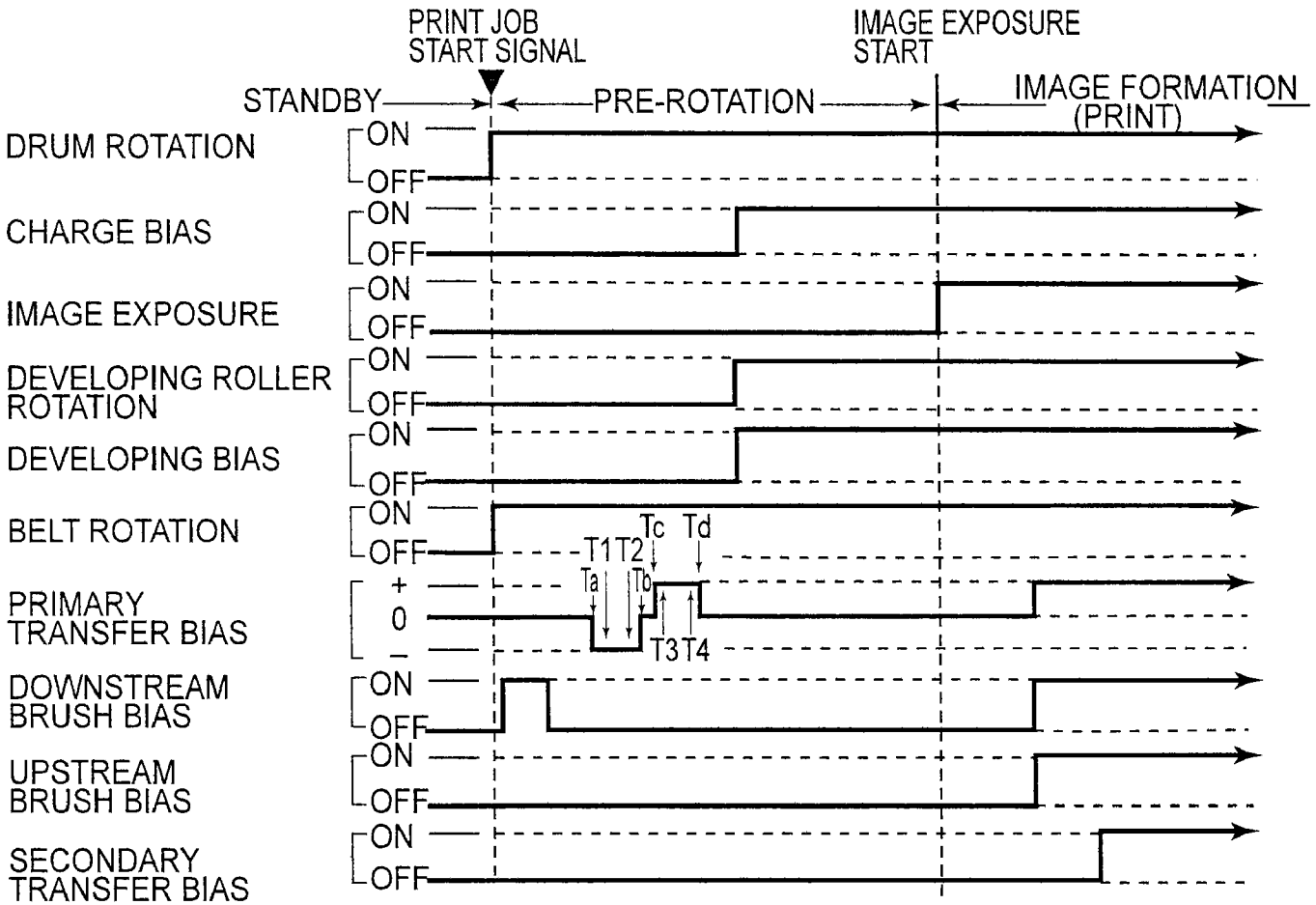

More specifically, in the case of the negative toner tn, as shown in time charts during the toner discharge in FIGS. 9 and 10, the bias applied to the primary transfer roller 15 is controlled to have a polarity opposite to the charge polarity of the negative toner as the normal toner. In FIG. 5, T3 represents a time at which a drum position at the contact portion f of the drum with the upstream brush 24 during a drum rotation stop state, i.e., a position of a drum portion on which the toner tn discharged from the upstream brush 24 is deposited reaches the primary transfer portion d after the drum 11 in the rotation stop state is rotationally actuated. Further, T4 represents a time at which the position of the drum portion has passed through the primary transfer portion d. The reaching time T3 and the passing time T4 can be estimated in advance from a peripheral length of the drum from the contact portion f to the primary transfer portion d with respect to the drum rotation direction, a width of the upstream brush 24 with respect to the drum rotation direction, and a width of the primary transfer portion d with respect to the drum rotation direction. Tc represents a third control time earlier than the reaching time T3 by a predetermined time, and Td represents a fourth control time later than the passing time T4 by a predetermined time.

The third and fourth control times Tc and Td are set as time limits in a timer function portion of the control circuit portion 100. The control circuit portion 100 starts a time period of the timer function portion simultaneously with the rotational actuation of the drum 11 in the rotation stop state.

The control circuit portion 100 controls the bias applied from the power source E6 to the primary transfer roller 15 so as to be changed from 0 V to +500 V at a time when the timer function portion counts the time limit Tc. As a result, application of a transfer bias of +500 V to the primary transfer roller 15 is started before the position of the negative toner tn deposited drum portion reaches the primary transfer portion d by rotationally actuating the drum 11.

Further, the control circuit portion 100 effects control so that the bias applied from the power source E6 to the primary transfer roller 15 is changed from +500 V to 0 V at a time when the timer function portion counts the time limit Td. As a result, the bias applied to the primary transfer roller 15 is returned from +500 V to 0 V after the negative toner tn deposited drum portion position passes through the primary transfer portion d.

As described above, by controlling the bias applied to the primary transfer roller 15, it is possible to remove not only the positive toner tp discharged from the downstream brush 17 onto the drum 11 but also the negative toner tn discharged from the upstream brush 24 onto the drum 11 from the surface of the drum 11 by efficiently transferring these positive and negative toners onto the belt 16. The thus transferred positive and negative toners onto the belt 16 can be collected by the brush cleaning apparatus 29.

In this embodiment, the above-described discharge sequence is performed with respect to the toners discharged from the auxiliary charging means 17 and 24 through mechanical vibration. As a result, a problem with respect to fog and image failure caused due to the positive and negative toners tp and tn deposited on the auxiliary charging means 17 and 24 during continuous image formation is solved.

In this embodiment, the negative toner discharged from the upstream (auxiliary charging) brush is discharged from the photosensitive drum. However, the negative toner can be collected by the developing device, so that the transfer voltage application may be turned off in the contact area between the upstream brush and the photosensitive drum, other than the constitution in this embodiment. Then, the drum is rotated in a state in which the negative toner is deposited on the photosensitive drum, so that the negative toner may be collected by the developing means.

Embodiment 3

Figure 11:
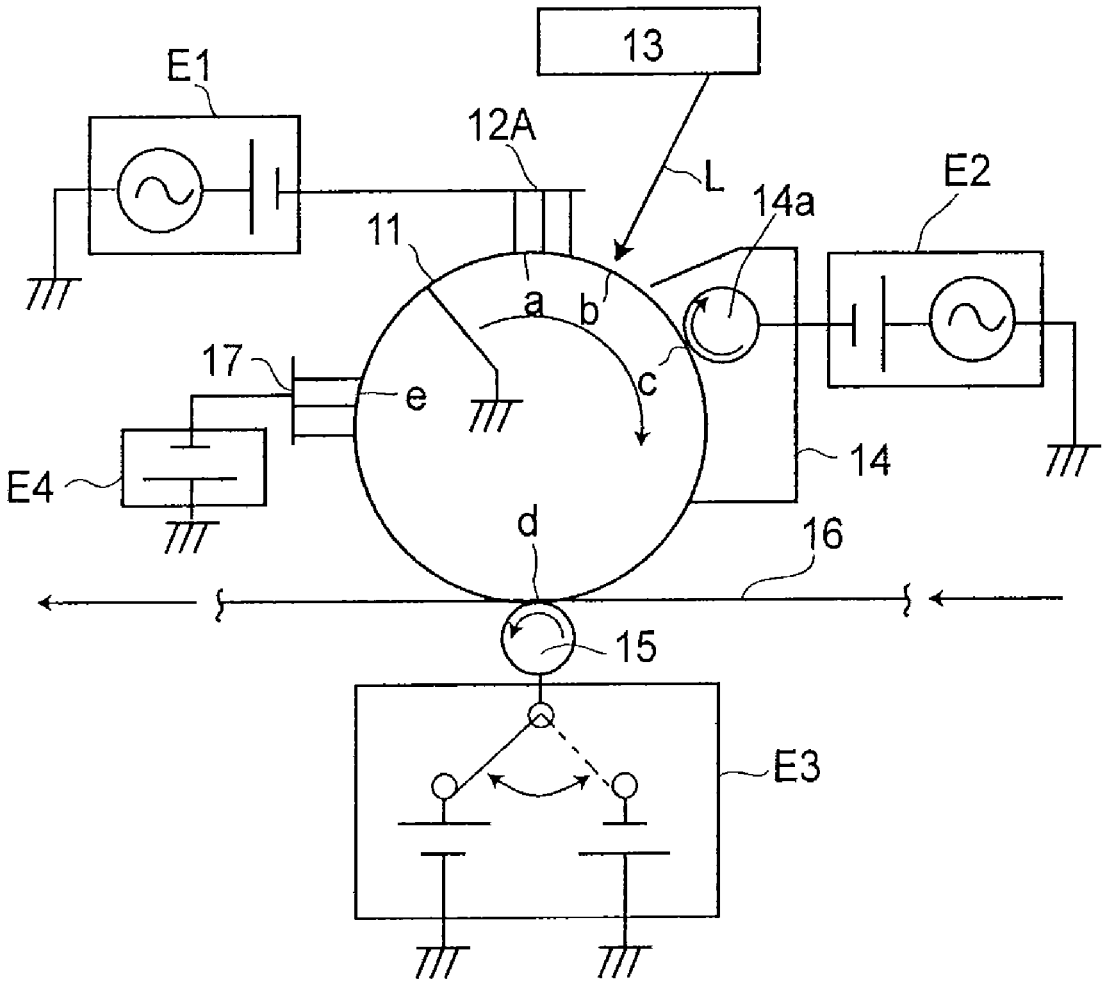
FIG. 11 is a schematic view for showing an image forming unit of an image forming apparatus in Embodiment 3.

An image forming apparatus of this embodiment includes a fixed contact charging brush 12A, as shown in FIG. 11, as the drum charging means for each image forming unit in this image forming apparatus in Embodiment 1. The toner discharge process is performed from the brush 17 as the auxiliary charging means and from the charging brush 12A, so that the toner is transferred onto the belt 16, thus being removed from the surface of the drum 11. Other mechanism constitutions are similar to those for the image forming apparatus in Embodiment 1, so that a redundant description will be omitted.

Figure 12:
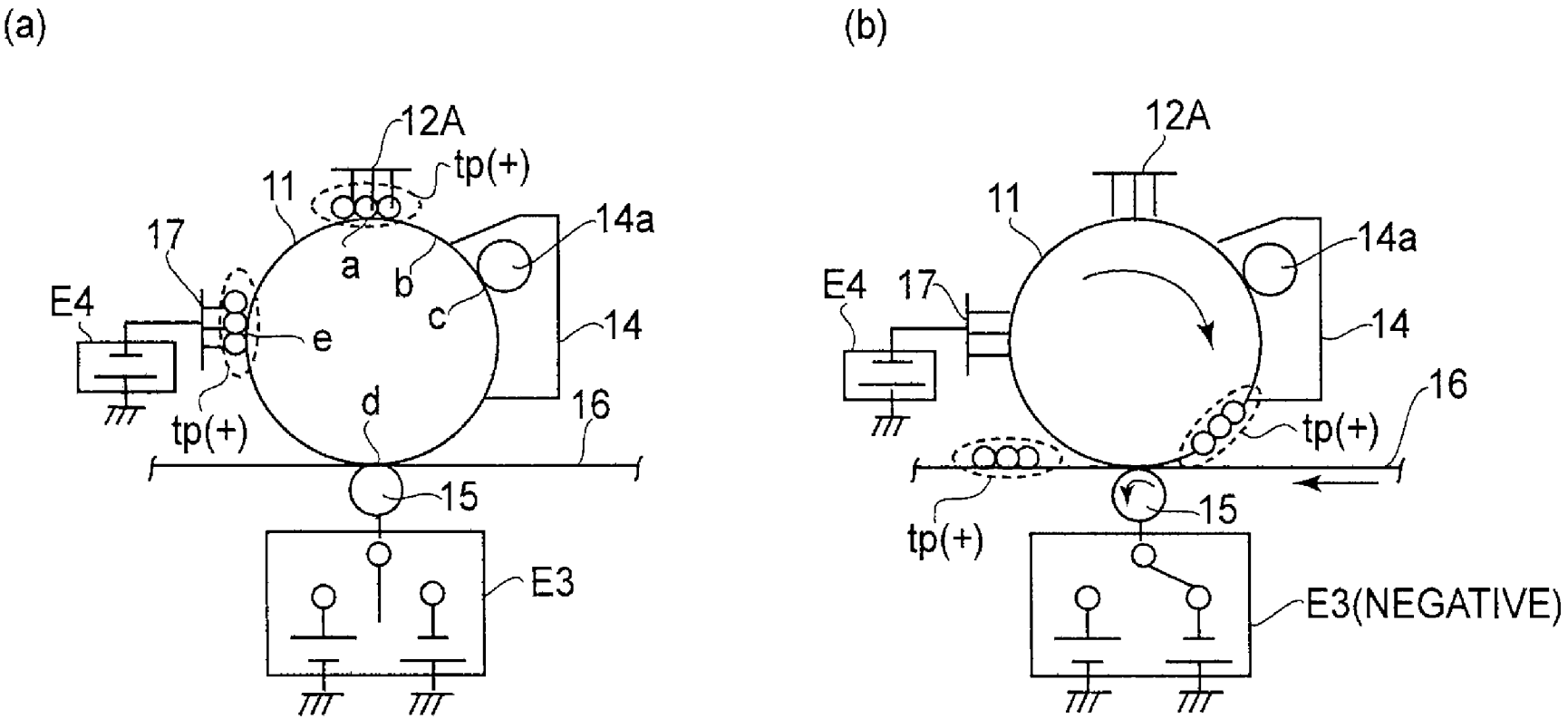
FIGS. 12(*a*) and 12(*b*) are schematic views for illustrating a toner discharging process of an image forming unit.

In this embodiment, during continuous image formation, the toner is deposited on both of the brush 17 and the charging brush 12A. The toner of the opposite polarity to the charge polarity of the negative toner as the normal toner is dominant in the toner deposited and accumulated on brush 17 and the charging brush 12A. By mechanical vibration during the drum rotation stop, toner is discharged from each of the brush 17 and the charging brush 12A onto the drum 11. FIG. 12(*a*) shows a state in which by mechanical vibration during the drum rotation stop, the positive toner tp is discharged from each of the brush 17 and the charging brush 12A onto the drum 11.

Figure 13:
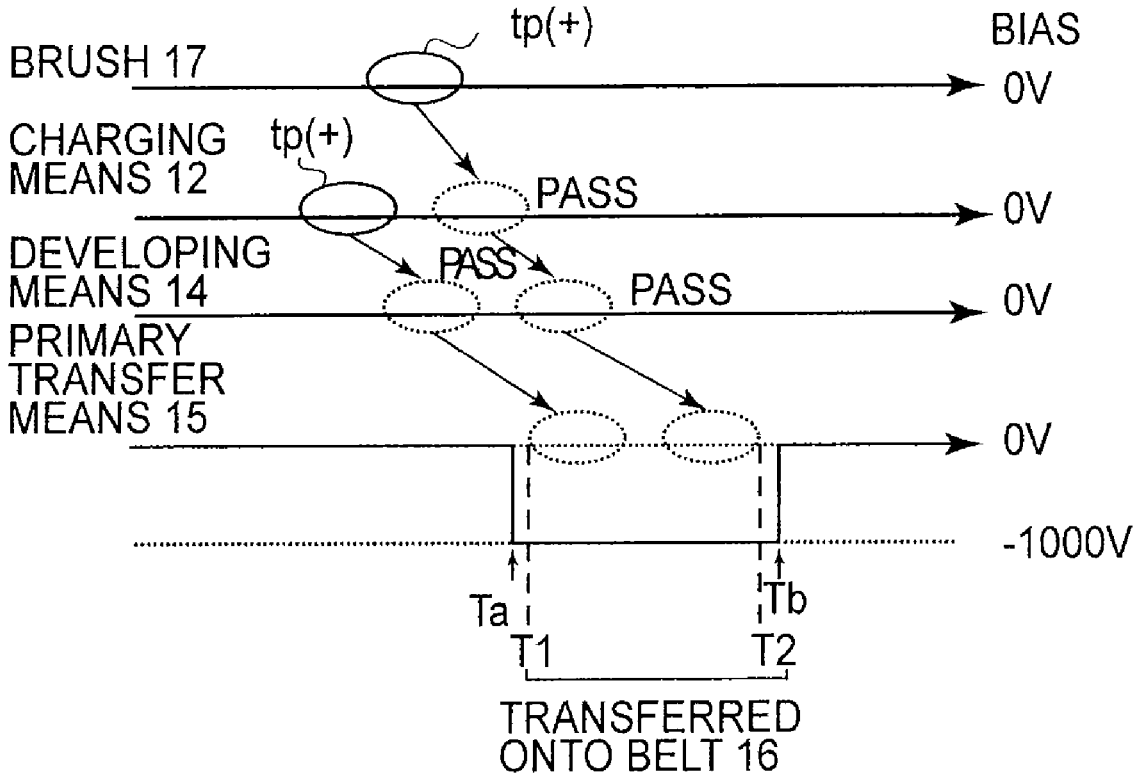
FIGS. 13 and 14 are time charts of a toner discharging process.
Figure 14:
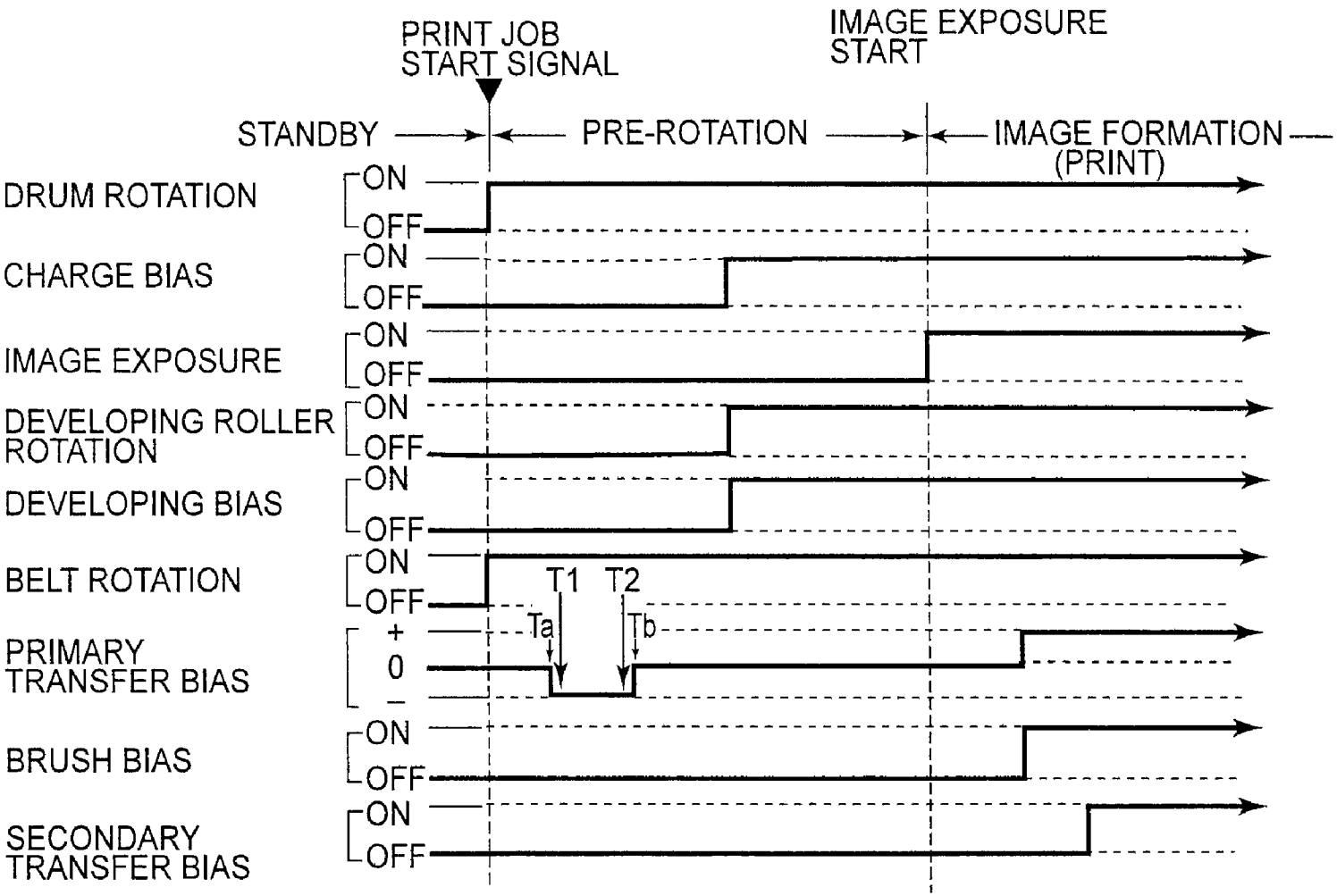

The control circuit portion 100 controls a bias applied to the primary transfer roller 15 as shown in FIGS. 13 and 14 before the positive toner tp discharged onto the drum 11 at the contact portion a between the drum 11 and the charging brush 12A reaches the primary transfer portion d by subsequent drum rotation. The applied bias is a negative bias of an identical polarity to the charge polarity of the negative toner as the normal toner. This bias application state is continued until the positive toner tp, deposited onto the drum 11 at the contact portion e between the drum 11 and the brush 17, passes through the primary transfer portion d.

In FIGS. 13 and 14, T1 represents a time at which a position of a drum portion on which the toner tp discharged from the charging brush 12A is deposited reaches the primary transfer portion d after the drum 11 is rotationally actuated. Further, T2 represents a time at which the position of the drum portion on which the toner tp discharged from the brush 17 is deposited has passed through the primary transfer portion d after the drum 11 is rotationally actuated.

As a result, the positive toner tp discharged from the charging brush 12A and the brush 17 onto the drum 11 is efficiently transferred onto the belt 16 at the primary transfer portion d, thus being removed from the surface of the drum 11. The thus transferred toner tp can be collected by the brush cleaning apparatus 29.

In this embodiment, the above-described discharge sequence is performed with respect to the toners discharged from the charging means 12A and the auxiliary charging means 17 through mechanical vibration. As a result, a problem with respect to fog and image failure caused due to the toners deposited on the charging means 12A and the auxiliary charging means 17 during continuous image formation is solved.

In this embodiment, the charging means 12A is the fixed brush but may also be a rotatable brush or a charging roller.

Embodiment 4

Figure 15:
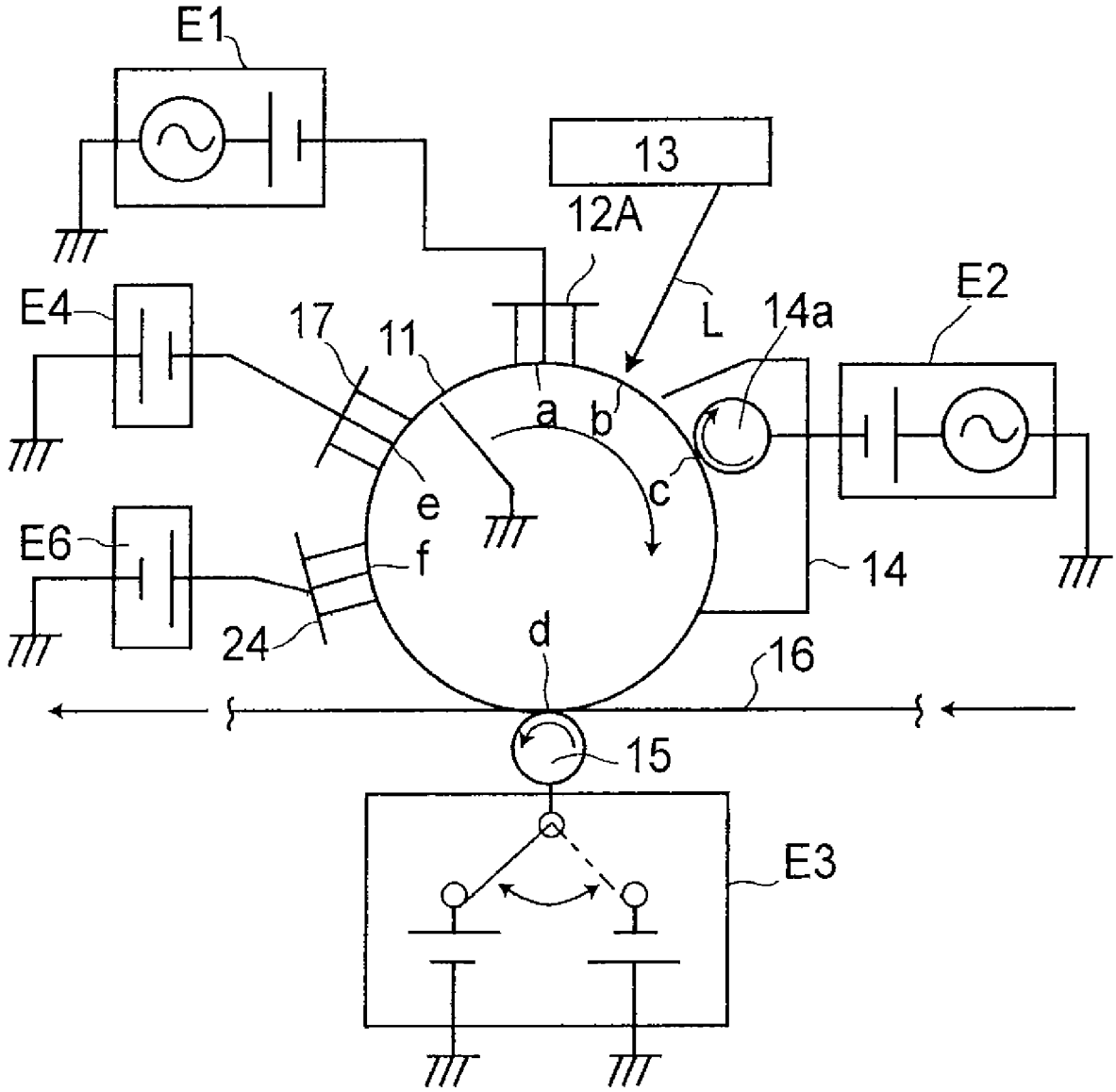
FIG. 15 is a schematic view showing an image forming unit of an image forming apparatus in Embodiment 4.

An image forming apparatus of this embodiment includes a fixed contact charging brush 12A, as shown in FIG. 15, as the drum charging means for each image forming unit in this image forming apparatus in Embodiment 2. The toner discharge process is performed from the charging brush 12A and the upstream and downstream auxiliary charging means 17 and 24, so that toner is transferred onto the belt 16, thus being removed from the surface of the drum 11. Other mechanism constitutions are similar to those for the image forming apparatus in Embodiments 1 and 2, so that a redundant description will be omitted.

Figure 16:
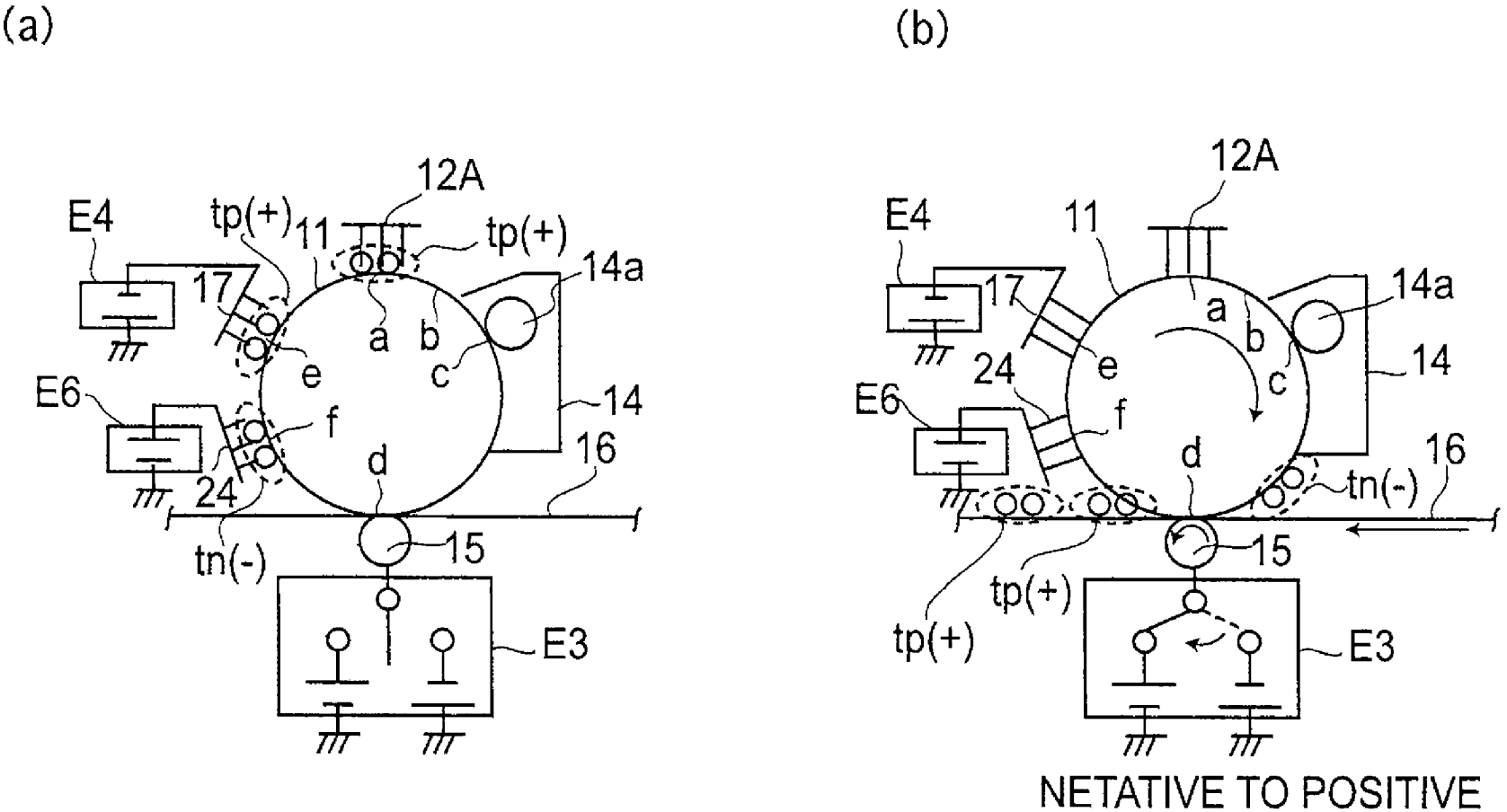
FIGS. 16(*a*) and 16(*b*) are schematic views for illustrating a toner discharging process of an image forming unit.

In this embodiment, during continuous image formation, the toner is deposited on both of the charging brush 12A and the upstream and downstream brushes 17 and 24 as the auxiliary charging means. The toner of the opposite polarity to the charge polarity of the normal toner (the negative toner) is dominant in the toner deposited and accumulated on charging brush 12A and the downstream brush 17. The negative toner of the identical polarity to the charge polarity of the normal toner is dominant in toner deposited and accumulated on the upstream brush 24. By mechanical vibration during the drum rotation stop, the toners are discharged from these three brushes 12A, 17 and 24 onto the drum 11. FIG. 16(*a*) shows a state in which by mechanical vibration during the drum rotation stop, the positive toner tp is discharged from each of the downstream brush 17 and the charging brush 12A onto the drum 11, and the negative toner is discharged from the upstream brush 24 onto the drum 11.

Figure 17:
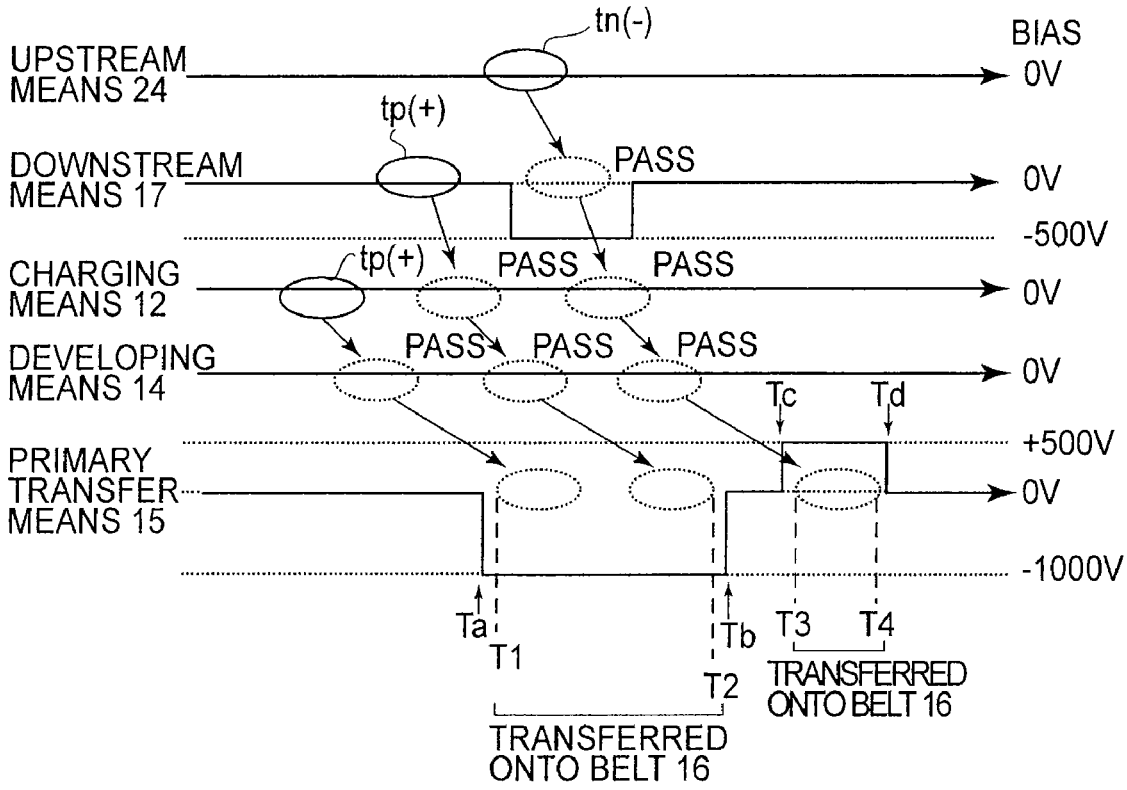
FIGS. 17 and 18 are time charts of a toner discharging process.
Figure 18:
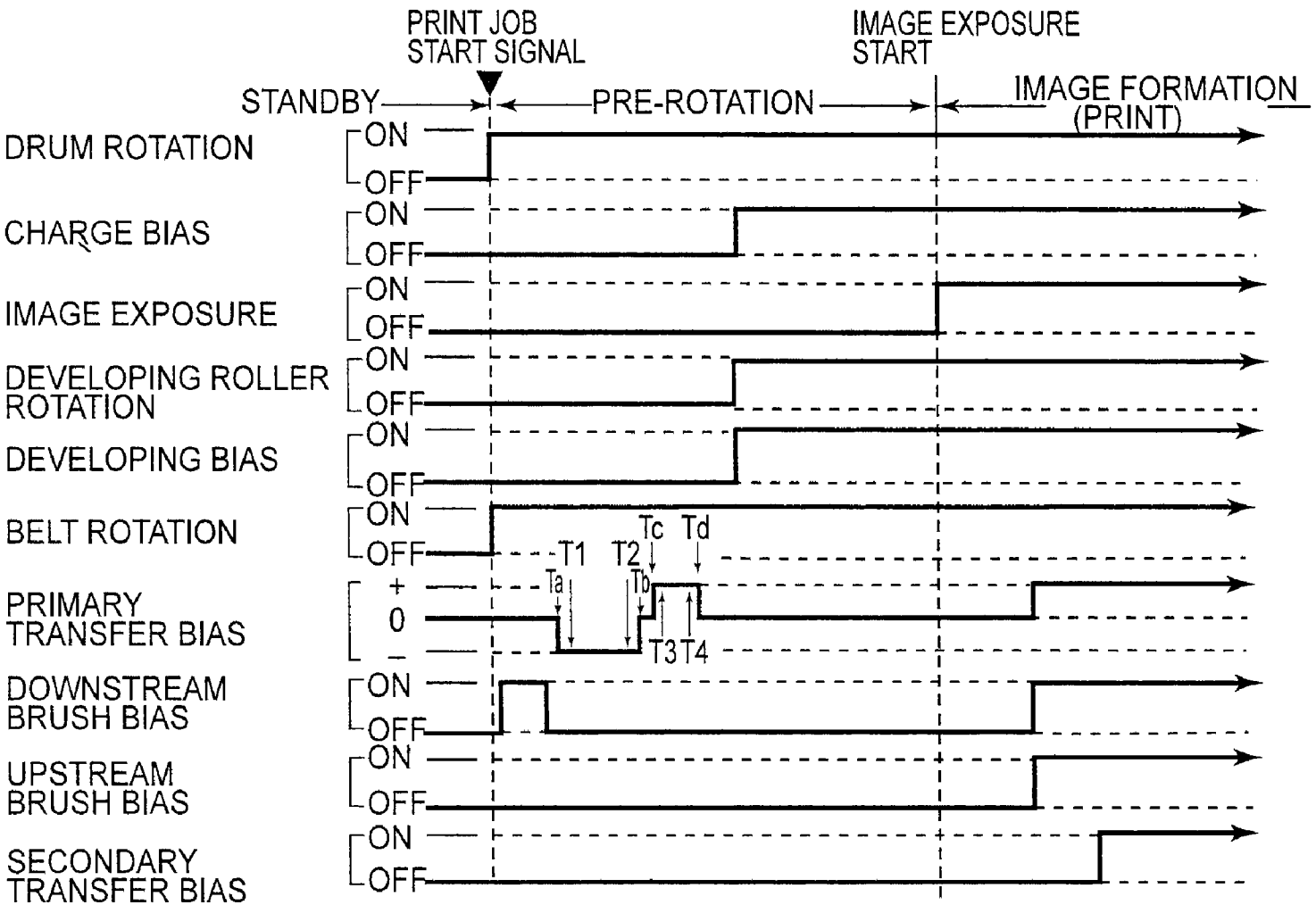

The control circuit portion 100 controls a bias applied to the primary transfer roller 15 as shown in FIGS. 17 and 18 before the positive toner tp discharged onto the drum 11 at the contact portion a between the drum 11 and the charging brush 12A reaches the primary transfer portion d by subsequent drum rotation. The control is effected in the same manner as in Embodiment 3, and the applied bias is a negative bias of an identical polarity to the charge polarity of the negative toner as the normal toner. This bias application state is continued until the positive toner tp deposited onto the drum 11 at the contact portion e between the drum 11 and the downstream brush 17 passes through the primary transfer portion d.

As a result, the positive toner tp discharged from the charging brush 12A and the upstream brush 24 onto the drum 11 is efficiently transferred onto the belt 16 at the primary transfer portion d, thus being removed from the surface of the drum 11.

Further, the control circuit portion 100 controls the bias applied to the primary transfer roller 15 as shown in FIGS. 16(*b*), 17 and 18 before the negative toner tn deposited onto the drum 11 at the contact portion f between the drum 11 and the upstream brush 24 reaches the primary transfer portion d subsequently to the positive toner tp. The control is performed in the same manner as in Embodiment 1.

To the negative toner tn discharged from the upstream brush 24, the bias of the identical polarity to the charge polarity of the negative toner is applied when the negative toner passes through the contact portion e between the downstream brush 17 and the drum 11, thereby to prevent the toner deposition contamination of the downstream brush 17.

Further, to the primary transfer roller 15, after the positive toner discharged from the downstream brush 17 passes through the primary transfer portion d and before the negative toner tn discharged from the upstream brush 24 reaches the primary transfer portion d, the bias of the opposite polarity to the charge polarity of the negative toner is applied. As a result, the negative toner tn discharged from the upstream brush 24 onto the drum 11 is efficiently transferred onto the belt 16, thus being removed from the surface of the drum 11.

In this embodiment, the above-described discharge sequence is performed with respect to the toners discharged from the charging means 12A and the auxiliary charging means 17 and 24 through mechanical vibration. As a result, a problem with respect to fog and image failure caused due to the toners deposited on the charging means 12A and the auxiliary charging means 17 and 24 during continuous image formation is solved.

In this embodiment, the charging means 12A is the fixed brush but may also be a rotatable brush or a charging roller.

Further, in the present invention, the toner carried and held by the image bearing member is transferred when the rotation of the stopped image bearing member is started. However, in combination thereof, there is no problem even when a discharge mode in which the toner deposited on the auxiliary charging member is discharged by periodically applying a voltage of an opposite polarity to a polarity of a voltage applied to the auxiliary charging member during the image formation.

The image forming apparatus of the present invention is not limited to a full-color image forming apparatus using the intermediary transfer member in the above-described embodiments. For example, the image forming apparatus may also employ a transferring method in which a transfer belt for conveying the recording material is used for directly transferring an image from the image bearing member onto the conveyed recording material. In such a case, toner is transferred onto the transfer belt provided with a cleaning means and the transferred toner is collected by the cleaning means. The present invention is also applicable to a cleanerless image forming apparatus for monochromatic image formation employing the simultaneous developing and cleaning method.

As described hereinabove, according to the present invention, it is possible to prevent the toner discharged mechanically from the auxiliary charging brush (member) by the rotation start of the image bearing member from deposited again on the auxiliary charging brush (member).

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 161002/2006 filed Jun. 9, 2006, which is hereby incorporated by reference.

What is claimed is:

1. An image forming apparatus, comprising:

a rotatable image bearing member;

a charging member for electrically charging said image bearing member in contact with said image bearing member;

an exposure device for exposing said image bearing member electrically charged by said charging member to light, thereby forming an electrostatic latent image;

developing means for collecting toner from said image bearing member and for developing the electrostatic latent image into a toner image on said image bearing member;

a belt member;

a transfer member for transferring the toner image toward said belt member at a transfer position;

removing means for removing toner on said belt member;

an auxiliary charging brush member for electrically charging toner remaining on said image bearing member after transferring the toner image, said auxiliary charging brush member contacting said image bearing member at a position downstream from the transfer position and upstream from said charging member with respect to a movement direction of said image bearing member, wherein a contact area is a portion of said image bearing member in contact with said auxiliary charging brush member before rotation of said image bearing member begins; and voltage control means for applying an identical polarity voltage, which is a voltage having a polarity identical to a normal charge polarity of the toner, to said transfer member for at least a period of time from when the contact area first reaches the transfer position to a time when the contact area passes through and departs from the transfer position.

2. An apparatus according to claim 1, wherein the identical polarity voltage is applied to said auxiliary charging brush member to electrically charge toner on said image bearing member.

3. An apparatus according to claim 1, wherein said charging member is a contact charging member to which the identical polarity voltage is applied after the contact area passes through and departs a charging member contact position between said contact charging member and said image bearing member.

4. An apparatus according to claim 3, wherein when the contact area is passing through the charging member contact position, a DC voltage is not applied to said contact charging member.

5. An apparatus according to claim 1, wherein after the contact area passes through and departs a position between said developing means and said image bearing member, the identical polarity voltage is applied, to said developing means.

6. An apparatus according to claim 5, wherein when the contact area is passing through the position between said developing means and said image bearing member, a DC voltage is not applied to said developing means.

7. An apparatus according to claim 1, wherein an opposite polarity voltage, which is a voltage of polarity opposite to the normal charge polarity of the toner, is applied to said transfer member after the contact area passes through and departs the transfer position.

8. An apparatus according to claim 1, wherein said auxiliary charging brush member is a first auxiliary charging brush member and the contact area is a first contact area, wherein said image forming apparatus further comprises a second auxiliary charging brush member which is disposed downstream from a transfer position and upstream from said first auxiliary charging brush member with respect to a movement direction of said image bearing member, and a second contact area is a portion of said image bearing member in contact with said second auxiliary charging brush member before rotation of said image bearing member begins, wherein said second auxiliary charging brush electrically charges toner remaining on said image bearing member after the transfer by applying an opposite polarity voltage, which is a voltage of polarity opposite to the normal charge polarity of the toner, to said second auxiliary charging brush member, and wherein said voltage control means applies the opposite polarity voltage to said transfer member for at least a period from a time when the second contact area first reaches the transfer position to a time when the second contact area passes through and departs from the transfer position.

9. An apparatus according to claim 8, wherein when the second contact area passes through a developing position between said developing means and said image bearing member, the identical polarity voltage is applied to said developing means.

10. An apparatus according to claim 8, wherein said charging member is a charging brush member and a third contact area is a portion of said image bearing member in contact with said charging brush member before the rotation of said image bearing member begins, and wherein said voltage control means applies the identical polarity voltage to said transfer member for at least a period from a time when the third contact area first reaches the transfer position to a time when the first contact area passes through and departs from the transfer position.

11. An apparatus according to claim 1, wherein the contact area is a first contact area, said charging member is a charging brush member, and a third contact area is a portion of said image bearing member in contact with said charging brush member before the rotation of said image bearing member begins, and wherein said voltage control means applies the identical polarity voltage to said transfer member for at least a period from a time when the third contact area first reaches the transfer position to a time when the first contact area passes through and departs from the transfer position.

12. An apparatus according to claim 1, wherein when rotation of said image bearing member is started by inputting an image forming signal, said voltage control means applies the opposite polarity voltage to said transfer member after applying the identical polarity voltage to said transfer member, and wherein the opposite polarity voltage is a voltage of polarity opposite to the normal charge polarity of the toner.

* * * * *